US008163670B2

(12) United States Patent
Miyata

(10) Patent No.: US 8,163,670 B2
(45) Date of Patent: Apr. 24, 2012

(54) THERMAL RECORDING MEDIUM, AND APPARATUS AND METHOD FOR IMAGE FORMATION

(75) Inventor: Hiroyasu Miyata, Osaki (JP)

(73) Assignee: Alps Electric Co., Ltd, Tokyo (JP)

( * ) Notice: Subject to any disclaimer, the term of this patent is extended or adjusted under 35 U.S.C. 154(b) by 603 days.

(21) Appl. No.: 12/294,119

(22) PCT Filed: Apr. 16, 2007

(86) PCT No.: PCT/JP2007/000414

§ 371 (c)(1),
(2), (4) Date: Mar. 16, 2009

(87) PCT Pub. No.: WO2007/125645

PCT Pub. Date: Nov. 8, 2007

(65) Prior Publication Data

US 2009/0170698 A1 Jul. 2, 2009

(30) Foreign Application Priority Data

Apr. 28, 2006 (JP) ..... 2006-125920
Dec. 22, 2006 (JP) ..... 2006-346634

(51) Int. Cl.
*B41M 5/34* (2006.01)

(52) U.S. Cl. ..... 503/201; 503/204; 503/205; 503/215

(58) Field of Classification Search ..... None
See application file for complete search history.

(56) References Cited

U.S. PATENT DOCUMENTS

| | | | |
|---|---|---|---|
| 6,417,915 | B1 | 7/2002 | Suzuki et al. |
| 6,482,471 | B1 | 11/2002 | Suzuki |
| 2003/0045426 | A1 | 3/2003 | Ito |

FOREIGN PATENT DOCUMENTS

| | | |
|---|---|---|
| JP | 61-40192 | 2/1986 |
| JP | 11-170692 | 6/1996 |
| JP | 2000-62322 | 2/2000 |
| JP | 2002-370456 | 12/2002 |

*Primary Examiner* — Bruce H Hess
(74) *Attorney, Agent, or Firm* — Young & Thompson

(57) ABSTRACT

To provide a thermal recording medium, which can realize easy maintenance, does not produce wastes such as cartridges, and can realize easy control of recording sheets, and an apparatus and method for image formation. [MEANS FOR SOLVING PROBLEMS]A high-temperature color development capsule (23), a low-temperature color development capsule (27), and a low-temperature color development suppression capsule (28) are incorporated in a recording sheet (10). In a printer, the low-temperature color development capsule (27) is subjected to low-temperature color development and is then pressed to break the low-temperature color development suppression capsule (28), whereby low-temperature color development is fixed. Thereafter, the high-temperature color development capsule (23) is subjected to high-temperature color development.

15 Claims, 21 Drawing Sheets

(A) ROOM TEMPERATURE (NON COLOR-FORMING TEMPERATURE)

(B) HIGH TEMPERATURE (COLOR-FORMING TEMPERATURE)

(ST3. 4) (ST5) (ST6)

THERMAL RECORDING MEDIUM, AND APPARATUS AND METHOD FOR IMAGE FORMATION

TECHNICAL FIELD

This invention relates to a thermal recording medium, an image-forming device that forms images on the thermal recording medium, and its method of image forming.

BACKGROUND ART

In currently used printers, there are several printing methods such as an inkjet printing method, a thermal transfer method, and a laser printing method in which a conventional copy machine is electronized. In these methods, ink, ink-ribbons, and toner are used to transfer data to a paper. Therefore when printing work has finished, used ink, ink cartridges, and ink-ribbons are discarded as industry wastes. For photograph printing, it is necessary to use a special paper.

But in the case of a thermal printer, though a special paper is necessary, it is not necessary to discard ink, ink cartridges and ink-ribbons. The thermal printing method has been adopted in facsimiles and bar code printing machines. However, the thermal printing method has too many problems to achieve a photograph-quality color image. At present, the thermal printing method cannot achieve photograph quality.

The largest technical problem is that a thermal head cannot control each of three-color layers independently by using its heat control, so that a color image of rich color gradation has not been achieved. However, there is only one product using the thermal printing method, which was released in 1996 and adopted a direct thermal recording method (TA method) based on a technical concept described in the Japanese patent document 1 below.

In the TA method, three thermal color-forming layers of cyan, magenta, and yellow are stacked up in order on a support sheet and a top layer is a thermal-protective layer. The yellow and magenta color-forming layers include diazonium salt compound and a coupler as a color developing material, which can be fixed with ultraviolet light. The cyan color-forming layer uses a dye precursor and organic acid as a color developing material, which does not need fixation. Microcapsules in each of the three layers have different thermal sensitivities and different ultraviolet sensitivities. These microcapsules are processed through five steps, using different thermal energy and different-wavelength ultraviolet light. Thus they are developed and fixed through the five steps to make a full-color print.

The five steps in the TA method are as follows: (1) forming a yellow image by using yellow information with low thermal energy, (2) radiating 419 nm ultraviolet light to an entire image to fix the yellow image, (3) forming a magenta image by using medium thermal energy (the developed yellow image is not affected by the medium thermal energy), (4) radiating 365 nm ultraviolet light to an entire image to fix the magenta image, and (5) forming a cyan image by using high thermal energy.

According to Japanese patent document 2 below, another method is described that uses the combination of three steps of different pressures and three steps of different temperatures, resulting in the chemical reaction between diazonium salt compound inside capsules and coupler outside capsules.

Japanese patent document 1: Japanese Unexamined Patent Application No. 61-40192

Japanese patent document 2: Japanese Unexamined Patent Application No. 11-170692

DISCLOSURE OF INVENTION

Problems to Be Solved by the Invention

The above-described TA method, however, has a problem that preservation of a recording sheet is difficult because the thermal sensitive layer is fixed by using ultraviolet light.

The system described in Japanese patent document 2 has also a problem that proper application of three-step pressure to a recording sheet is difficult.

An object of the present invention is to provide a thermal recording medium that is easy to control, an image-forming device that is easy to maintain, and a method of image forming that is easy to form an image on the thermal recording medium without producing industrial waste such as cartridges.

Means Used to Solve the Problems

To solve the above mentioned problem and to achieve the above mentioned object, the present invention of the claim 1 is a thermal recording medium comprising: a first color-forming element that forms a color at a first color-forming temperature; a second color-forming element that forms a color at a second color-forming temperature, the second color-forming temperature being higher than the first color-forming temperature; and a color-inhibiting element that inhibits a color-forming capability of the first color-forming element on condition that the color-inhibiting element is pressured by a predetermined pressure.

As described above, according to the present invention of the claim 1 inhibiting a color-forming capability of the first color-forming element on condition that the color-inhibiting element is pressured by a predetermined pressure, the first color-forming element can be fixed without using ultraviolet rays to make it easy to manage the thermal recording medium.

The present invention of the claim 2 is the thermal recording medium, comprising: a first color-forming layer that includes the first color-forming elements; a second color-forming layer that includes the second color-forming elements; and a color-inhibiting layer that includes the color-inhibiting elements, the color-inhibiting layer being in contact with the first color-forming layer.

The present invention of the claim 3 is the thermal recording medium according to claim 1, comprising: a first color-forming layer that includes a mixture of the first color-forming elements and the color-inhibiting elements; and a second color-forming layer that includes the second color-forming elements.

The present invention of the claim 4 is the thermal recording medium according to claim 1, comprising: N (an integer not less than 3) types of color-forming elements including the first color-forming element and the second color-forming element; and (N-1) types of color-inhibiting elements that inhibit the color-forming capabilities of (N-1) types of color-forming elements, the (N-1) types of color-forming elements being sequenced in order from a type of a smaller color-forming temperature to the (N-1) type of a larger color-forming temperature, wherein each of the (N-1) types color-inhibiting elements inhibits a capability of an associated color-forming element on condition that the each color-inhibiting element is pressured and heated at a color-inhibiting temperature that is higher than that of another color-inhibiting element which inhibits a capability of a color-forming element having a color-forming temperature less than that of the associated color-forming element, and is lower than that of another color-inhibiting element which inhibits a capability of a color-forming element having a color-forming temperature more than that of the associated color-forming element.

According to the invention of the claim 4 not less than 3 of color can be formed.

The present invention of the claim 5 is the thermal recording medium of claims 1-4, wherein each of the color-forming elements are placed in order from a heating side of the thermal recording medium toward the color-forming element having a lower color-forming temperature.

The present invention of the claim 6 is the thermal recording medium of claims 1-4, wherein each of the color-forming elements are placed in order from a heating side of the thermal recording medium toward the color-forming element having a higher color-forming temperature.

According to the invention of the claim 6, the color-forming elements are placed in order from a heating side of the thermal recording medium toward the color-forming element having a higher color-forming temperature. So that the energy when heating it can be reduced.

The present invention of the claim 7 is the thermal recording medium of claim 1, wherein layers such as a layer including high-temperature color-forming elements, a layer including low-temperature color-forming elements, a layer including color-inhibiting elements to inhibit the low-temperature color-forming elements, a heat barrier layer, and a layer including medium-temperature color-forming elements are placed in order from a heating side of the thermal recording medium.

According to the invention of the claim 7, a layer including low-temperature color-forming elements, a layer including color-inhibiting elements to inhibit the low-temperature color-forming elements, and a heat barrier layer are placed between a layer including high-temperature color-forming elements and a layer including medium-temperature color-forming elements. So that the layer including medium-temperature color-forming elements is prevented from being formed by the heat when high-temperature color-forming without fixing the layer including medium-temperature color-forming elements.

The present invention of the claim 8 is the thermal recording medium of claim 1, wherein layers such as a layer including low-temperature color-forming elements, a layer including color-inhibiting elements that inhibit the low-temperature color-forming elements, a layer including high-temperature color-forming elements, a heat barrier layer, and a layer including medium-temperature color-forming elements are placed in order from the heating side of the thermal recording medium.

According to the invention of the claim 8, it is possible to inhibit the layer including medium-temperature color-forming elements from being formed by heat when high-temperature color forming without fixing the low-temperature color-forming layer by placing the heart barrier layer between the layer including high-temperature color-forming elements and the layer including medium-temperature color-forming elements. The thickness of the thermal recording medium can be thinned and the step for image forming can be reduced because of unnecessary of the layer including medium-temperature color-forming elements. According to the invention of the claim 8, the layer including color-inhibiting elements is placed on the side being pressed. So that it is possible to apply appropriate pressure to the layer including color-inhibiting elements.

The present invention of the claim 9 is the thermal recording medium of claim 1, wherein the color-forming element forms a color by releasing a substance inside the color-forming element and reacting it with a substance outside the color-forming element, or by letting the substance outside the color-forming element into the color-forming element and react it with the substance inside the color-forming element.

The present invention of the claim 10 is the thermal recording medium of claim 1-9, wherein the color-inhibiting element has capabilities such as: a capability to inhibit color-forming reaction by changing a chemical constitution of one or more of color-forming-element substances such as electron donative dye precursor, electron acceptive color developer, basic substance, and acid substance; a capability not to produce color dyes despite occurrence of chemical reaction by changing a chemical constitution of one or more of color-forming-element substances such as electron donative dye precursor, electron acceptive color developer, basic substance, and acid substance; and a capability to inhibit color-forming reaction by decreasing permeability of a microcapsule wall of the color-forming element.

The present invention of the claim 11 is the mage forming device comprising: a thermal head that records an image on a thermal recording medium; a pressure unit that provides a pressure to inhibit a low-temperature color-forming capability of the thermal recording medium; a process that controls the thermal head to record an image on the thermal recording medium at the low temperature in the color forming; a process that controls the pressure unit to provide the pressure to the thermal recording medium; and a control unit that sequentially performs processes to control the thermal head to record an image on the thermal recording medium at a temperature higher than the low temperature in the color forming.

According to the invention of the claim 11, on the basis of the control of the control means the thermal head records an image on the thermal recording medium at a low temperature in the color forming.

Next the pressure unit provides a pressure to the thermal recording medium to fix the low temperature color-forming.

Next the thermal head records an image on the thermal recording medium at a high temperature in the color forming.

The present invention of the claim 12 is the mage forming device of claim 11, wherein the control unit sequentially performs processes such as a process that control the thermal head to record an image on the thermal recording medium at the low temperature in the color forming, a process that control the pressure unit to provide the pressure to the thermal recording medium at a breaking low temperature, a process that controls the thermal head to record an image on the thermal recording medium at a temperature higher than the low temperature in the color forming and lower than the high temperature in the color forming, a process that controls the pressure unit to provide the pressure to the thermal recording medium at a breaking medium temperature higher than the breaking low temperature, and a process that controls the thermal head to record an image on the thermal recording medium at the high-temperature in the color forming.

According to the invention of the claim 12, on the basis of the control of the control means the thermal head records an image on the thermal recording medium at a low temperature in the color forming.

Next the pressure unit provides a pressure at a breaking low temperature to the thermal recording medium to fix the low temperature color-forming.

Next the thermal head records an image on the thermal recording medium at a medium temperature in the color forming.

Next the pressure unit provides a pressure at a breaking medium temperature to the thermal recording medium to fix the medium temperature color-forming.

Next the thermal head records an image on the thermal recording high at a medium temperature in the color forming.

The present invention of the claim 13 is the mage forming device of claim 11, wherein the control unit sequentially controls processes such as a process that controls the thermal head to record an image on the thermal recording medium at the low temperature in the color forming, a process that controls the pressure unit to provide the pressure to the thermal recording medium, a process that controls the thermal head to record an image on the thermal recording medium at the high temperature in the color forming and for a first period of time, a process that controls the thermal head to record an image on the thermal recording medium at a medium temperature higher than the low temperature and lower than the high temperature in the color forming and for a second period of time longer than the first period of time.

According to the invention of the claim 12, on the basis of the control of the control means the thermal head records an image on the thermal recording medium at a low temperature in the color forming.

Next the pressure unit provides a pressure at a breaking low temperature to the thermal recording medium to fix the low temperature color-forming.

Next the thermal head records an image on the thermal recording medium at a high medium temperature in the color forming and for a first period of time. At this time, the first period of time is too short for the medium temperature is transmitted to the medium temperature color-forming elements not to form the medium temperature color forming.

Next the thermal head records an image on the thermal recording medium at a high medium temperature in the color forming and for a second period of time shorter than the first period of time.

The present invention of the claim 14 is the mage forming device of claim 11-13, wherein the thermal head is in contact with the pressure unit.

The present invention of the claim 14 is the mage forming device of claim 11-13, wherein the thermal head and the pressure unit are combined so that the thermal heating-side is in contact with the thermal recording medium and provides the pressure to the thermal recording medium.

The present invention of the claim 14 is an image forming method comprising: a first process of heating a thermal recording medium to record an image at a low temperature in color forming, a second process of pressuring the thermal recording medium after the first process in order to inhibit the low-temperature color-forming, and a third process of heating the thermal recording medium at a high temperature in the color forming that is higher than the low temperature in the color forming in order to record an image on the thermal recording medium.

Effect of the Invention

The present invention can provide a thermal recording medium, an image-forming device, and an image-forming method, wherein it is easy to maintain the image-forming device, to form an image on the thermal recording medium without producing industrial waste such as cartridges, and to preserve the thermal recording medium.

BEST MODE FOR CARRYING OUT THE INVENTION

The following embodiments of the present invention will be described with reference to a recording sheet and a printer that forms an image on the recoding sheet.

First Embodiment

The first embodiment of the present invention will be described below.

[Relation Between Embodiments and Invention]

First, relation between components in the present embodiment and elements in the invention will be described. Referring to FIG. 1 of the present embodiment, a low-temperature color-forming capsule 27 corresponds to a first color-forming element in claim 1, and a high-temperature color-forming capsule 23 corresponds to a second color-forming element in claim 1.

The low-temperature color-inhibiting capsule 28 corresponds to a color-inhibiting element in claim 1.

Referring to FIG. 6, a thermal head 45 corresponds to a thermal head in claim 11, and pressure rollers 49*a* and 49*b* correspond to a pressure roller in claim 11.

A controller 51 in FIG. 6 corresponds to a controlling unit in claim 11.

[Recording Sheet]

A recording sheet in the present embodiment will be described.

FIG. 1 is a schematic view of a recording sheet 10 in accordance with the first embodiment of the present invention.

As shown in FIG. 1, the recording sheet 10 has a support sheet 11 on which high-temperature color-forming layer 13, a mixing prevention layer 15, a low-temperature color-forming layer 17, and a protective layer 19 are stacked up in order.

The low-temperature color-forming layer 17 of the recording sheet 10 includes low-temperature color-forming capsules 27 and low-temperature color-inhibiting capsules 28. In an image-forming process, the low-temperature color-forming capsules 27 are developed at a low temperature and then are fixed at a low-temperature by pressuring and breaking the low-temperature color-inhibiting capsules 28. Then high-temperature color-forming capsules 23 are developed at a high-temperature.

The support sheet 11, for example, is made of material such as polyester or polyethylene terephthalate (PET). The support sheet 11 is white color or transparent.

The high-temperature color-forming layer 13 includes high-temperature color-forming capsules 23, color developer, and, if necessary, binder in which basic substance or acid substance are suspended. The high-temperature color-forming capsule 23 includes color former. In the high-temperature color-forming layer 13, when temperature is higher than T3 (for example 330° C.) as shown in FIG. 2, the color former in the high-temperature color-forming capsule 23 reacts with the color developer and produces color.

The high-temperature color-forming capsule 23 is a microcapsule having a shell of polyurea or polyurethane that has a glass-transition point of 300° C.-350° C. The high-temperature color-forming capsule 23 increases permeability around the glass-transition point. As shown in FIG. 3(A), at a temperature lower than T, since the color developer cannot permeate the high-temperature color-forming capsule 23, the color former in the capsule 23 does not produce color. Meanwhile, as shown in FIG. 3(B), at a temperature higher than T, since the color developer in the high-temperature color-forming layer 13 permeates the high-temperature color-forming capsule 23, the color developer reacts with the color former in the capsule 23 and forms dyes, resulting in color.

The shell of a microcapsule such as the high-temperature color-forming capsule 23 in the present embodiment is made from synthetic resin such as thermosetting resin or thermoplastic resin. Materials of the shell of the high-temperature color-forming capsule 23, specifically, are melamine-formaldehyde polymer, urea-formaldehyde polymer, and the like.

An average diameter of microcapsules is 3 to 4 μm. Its glass-transition point depends upon a kind of material. The substances are not only separated by the multi-layer structure but also the microcapsule shell. Since the substances are suspended inside and outside of a shell wall of several μm, they are separated enough at room temperature. But they instantly become permeable when they are heated.

It is possible that when the high-temperature color-forming capsule 23 is at the above-mentioned high-temperature, the shell is melt and the color former in the capsule flows out of the shell and react with the color developer to produce color.

Possible combinations of a color former and a corresponding color developer in the present embodiment are, for example, combination of diazonium compound (color former) and coupler (color developer) or combination of electron donative colorless dye (color former) and electron acceptive compound (color developer). With reference to combination of color developer and color former, the combination of diazonium compound and coupler and the combination of electron donative colorless dye and electron acceptive compound are known.

The above-mentioned diazonium compound, for example, is tricresyl phosphate. The diazonium compound is electron donative dye precursor (dye precursor) and reacts with coupler in basic atmosphere. The coupler, for example, is resorcylate or phloroglucin and couples with diazonium compound to form dyes in basic atmosphere. The basic atmosphere is formed by water-insoluble or soluble base or by a substance to produce alkali by heating (for example, organic ammonium salt).

The above-mentioned electron donative colorless dye is, for example, leuco dye and the electron acceptive compound is, for example, phenolic acid substance. In this combination, the leuco dye sticks to an acid color developer, so that it is oxidized and developed.

The above-mentioned coupler is, for example, 2-hydroxy-3 naphthoic acid anilide.

The above-mentioned electron acceptive compounds are, for example, acid substances such as phenolic compound, organic acid or its metallic salt, and hydroxybenzoate.

In the present embodiment, though the color former is included in a microcapsule, it is also possible that the color former and the color developer are suspended in the binder and the binder is melt by heating so that the color former reacts with the color developer.

A mixing prevention layer 15 prevents microcapsules from mixing in the high-temperature color-forming layer 13 and the low-temperature color-forming layer 17.

The low-temperature color-forming layer 17 includes the low-temperature color-forming capsule 27, the color developer, the low-temperature color-inhibiting capsule 28, and, if necessary, binder that suspends basic substance or acid substance. The low-temperature color-forming capsule 27 includes the color former and its shell has a glass-transition point of, for example, 90-140° C. With regard to the low-temperature color-forming layer 17, when temperature is at a low-temperature higher than T1 (for example, 110° C.), the color former in the low-temperature color-forming capsule 27 reacts with the color developer in the low-temperature color-forming layer 17 and produces color. Except for the glass-transition point of the shell of low-temperature color-forming capsule 27, a color-forming principle is the same as that of the high-temperature color-forming capsule 23.

In the present embodiment, the color former in the capsules 23 and 27 and the color developer outside the capsules do not need to be pressured as a condition of chemical reaction.

The low-temperature color-inhibiting capsule 28, as shown in FIG. 4(A), includes low-temperature color inhibitor that inhibits color-forming capability of the low-temperature color-forming layer 17 under a normal pressure (non-breaking pressure).

The low-temperature color-inhibiting capsule 28, as shown in FIG. 4(B), is broken (or permeable) when a pressure higher than breaking pressure P1 as shown in FIG. 2 is applied to the capsule 28, so that the low-temperature color inhibitor flows out of the capsule 28.

The breaking (or permeable) pressure of a microcapsule such as the low-temperature color-inhibiting capsule 28 is determined by its shell wall strength and the relation between a diameter and a shell wall thickness of the microcapsule.

The low-temperature color-inhibitor in the capsule 28 has two capabilities, one is to inhibit chemical reaction and the other is to prevent production of dyes despite occurrence of chemical reaction. The capabilities are achieved by changing chemical structure of one or more substances such as the color former in the capsule 27, the color developer in the layer 17, basic substance, and acid substance.

The following will describe an embodiment of the latter capability. Specifically, as shown in FIG. 5, when pressure higher than the breaking pressure P1 is applied to the low-temperature color-inhibiting capsule 28, the low-temperature color inhibitor flows out of the capsule 28 and the low-temperature color inhibitor makes chemical reaction with the color developer (coupler), so that transparent compound (colorless product) 285 is produced. The product 285 is colorless because the product 285 does not couple with the color former of diazonium salt in the low-temperature color-forming capsule 27 and therefore a dye is not produced in the low-temperature color-forming capsule 27 (color-inhibiting capability).

The product 285 does not change the color that has been already developed because the product 285 does not make a chemical reaction with the developed color. The low-temperature color inhibitor does not change the developed color because the low-temperature color inhibitor does not make a chemical reaction with the developed color.

As described above, since the product 285 is colorless substance that has been produced by the reaction of the coupler and the low-temperature color inhibitor by pressuring the low-temperature color-forming capsule at a pressure higher than the breaking pressure P1, the low-temperature color-forming layer 17 of the recording sheet 10 does not produce an unnecessary color.

The following is an example of the color former, the low-temperature color inhibitor, the coupler, and the product 285, which realize the above-mentioned color-inhibiting reaction.

Example 1

In one example, diazonium salt (2,5 dibutoxy-4-tolylthio benzene diazonium hexafluorophosphate) was used as a color former, a yellow substance called COAAA (2-chloro-5-octyl acetoacetanilide) provided by formula (1) was used as a coupler, and azobenzene provided by formula (2) was used as a low-temperature color inhibitor. The resultant diazo-coupling reaction caused by the coupler and the azobenzene produced product 285, which was colorless COOP (azo dye) provided by formula (3). The COOP has a structure of N-(2-chloro-5-octylphenyl)-3-oxo-2-phenylazobutylamino.

As described above, the color inhibitor inhibited the reaction between the diazonium salt and the coupler. The product 285 produced by the color inhibitor and the coupler did not change the color of dyes that had been developed. The color inhibitor did not change the color of dyes that had been developed. Since the product 285 was colorless, it did not produce unnecessary color. Since the product 285 produced by the color inhibitor and the coupler was thermally stable, thermal energy change caused by adding heat did not change the color of the recording sheet 10.

[Chemical formulae 1]

(1)

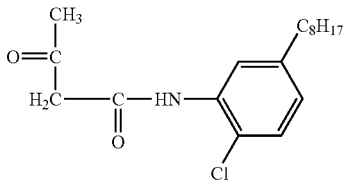

[Chemical formulae 2]

(2)

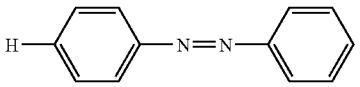

[Chemical formulae 3]

(3)

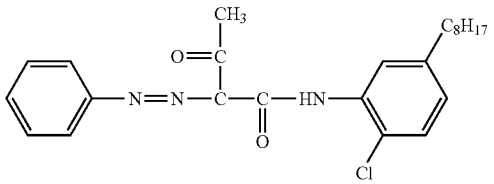

Example 2

In another example, diazonium salt was used as a color former, a substance provided by the formula (1) was used as a coupler, and a substance (pento-1-en-3-on) provided by formula (4) was used as a color inhibitor. The resultant Michael reaction caused by the coupler and the color inhibitor produced the product 285, which was AHCOA (2-acetyl-5-oxo-enanthic acid (2-chloro-5-octylphenyl)amide) provided by formula (5).

The Michael reaction was produced under basic atmosphere and the resultant product coupled to the same part as the diazonium salt coupled to. This inhibited the coupling of the diazonium salt, so that it could not produce color.

The absorption wavelength of the product 285 produced by the Michael reaction was approximately the same as that of the coupler. While the coupler was transparent, the product 285 produced by the Michael reaction was transparent. The product 285 was so thermally stable that it could not be resolved at about 200° C. thus the recording sheet 10 did not change color.

The product 285 produced by the color inhibitor and the coupler did not change the color of dyes that had been already developed. The color inhibitor did not change the color of dyes that had been already developed. Since the product 285 was colorless, it added no unnecessary color.

[Chemical formulae 4]

(4)

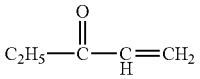

[Chemical formulae 5]

(5)

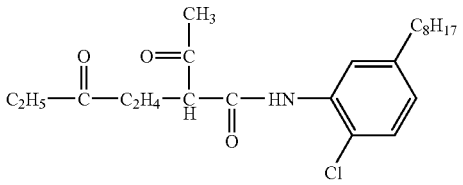

Example 3

In another example, diazonium salt was used as a color former, PMP (1-phenyl-3-methyl-5-pyrazolone) provided by formula (6) was used as a coupler for a magenta color, and azobenzene provided by the formula (2) as a color inhibitor. The resultant diazo-coupling reaction caused by the coupler and the azobenzene produced the product 285, which was a colorless azo dye (5-methyl-2-phenyl-4-phenylazo-2,4-dihydropyrazolone-3-on) provided by formula (7).

The resultant effects brought by combinations of the color former, the coupler, the color inhibitor, and the product 285 were approximately the same as those of the first example.

[Chemical formulae 6]

(6)

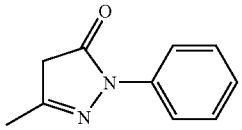

[Chemical formulae 7]

(7)

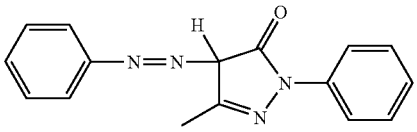

Example 4

In another example, the above-described color former and the coupler provided by the formula (6) were used, and substance (pento-1-en-3-on) provided by the formula (4) was used as a color inhibitor. The resultant Michael reaction caused by the coupler and the color inhibitor produced the product 285, which was a colorless substance called MOPDP (5-methyl-4-(3-oxopentyl)-2-phenyl-2,4-dihydropyrazolone-3-on) provided by formula (8).

The resultant effects brought by the combination of the color former, the coupler, the color inhibitor, and the product 285 were approximately the same as those of the second example.

[Chemical formulae 8]

(8)

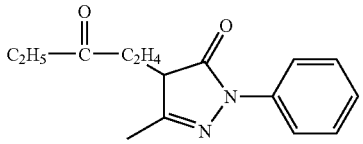

Example 5

In another example, the above-mentioned coupler was used, and an orange-colored substance called HNAA (2-hydroxy-3-naphthoic acid anilide) provided by formula (9) was used as a coupler, and substance (pento-1-en-3-on) provided by the formula (4) as a color inhibitor. The resultant Michael reaction caused by the coupler and the color inhibitor produced the product 285, which was colorless HNCP (3-hydroxy-4-(3-oxopentyl)-naphthalene-2-carboxylic acid phenylamide) provided by formula (10).

The resultant effects produced by the combination of the color former, the coupler, the color inhibitor, and the product 285 were approximately the same as those of the second example.

[Chemical formulae 9]

(9)

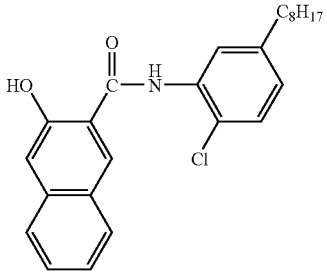

[Chemical formulae 10]

(10)

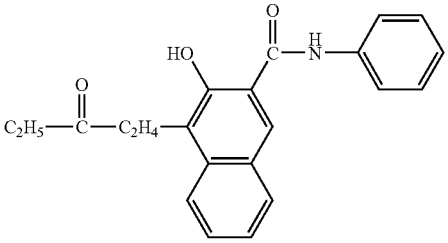

Example 6

In another example, the above-mentioned color former was used, and substance called DHN (1,5-dihydroxynaphthalene) provided by formula (11) was used as a coupler, and substance (pento-1-en-3-on) provided by the formula (4) was used as a color inhibitor. The resultant Michael reaction caused by the coupler and the color inhibitor produced the product 285, which was a colorless substance called DNP (1-(1,5-dihydroxynaphthalene-2-yl)-pentane-3-on).

The resultant effects brought by the combination of the color former, the coupler, the color inhibitor, and the product 285 were approximately the same as those of the second example.

[Chemical formulae 11]

(11)

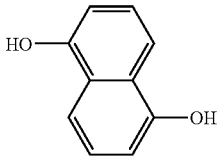

[Chemical formulae 12]

(12)

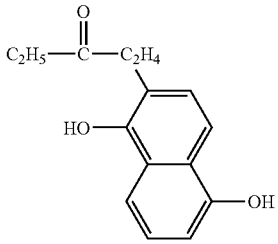

Referring to FIG. 1, the low-temperature color-inhibiting capsule 28 may have a capability to inhibit color-forming by decreasing the permeability of the shell wall substance of the low-temperature color-forming capsule 27.

In the present embodiment, when the low-temperature color inhibitor flows out of the low-temperature color-inhibiting capsule 28, condition for temperature is not necessary.

In the low-temperature color-forming layer 17, when color-forming is performed by the combination of electron donative colorless dye (as a color former, for example, leuco dye) and electron acceptive compound (as a color developer, for example, acid substance), the following substances are used for the low-temperature color-inhibiting capsule 28, for example, a phosphate group, tetrahydrophthalate, fatty acid ester, a dihydric alcohol group, epoxy plasticizer, and trimellitic acid plasticizer.

The protective layer 19 protects the low-temperature color-forming layer 17. The protective layer 19, for example, has a thermal resistant feature.

In the present embodiment, a thickness of the high-temperature color-forming layer 13 or the low-temperature color-forming layer 17 is, for example, 1-4 μm.

The following explains one embodiment of a printer that prints an image on the recording sheet 10.

The printer described in the present embodiment is one example. There are another modifications to the printer that will be described later.

FIG. 6 is a cross-sectional view of a printer 40 that prints an image on the recording sheet 10.

As shown in FIG. 6, the printer 40, for example, includes a sheet container 41, a sheet transfer roller 43, a thermal head 45, a platen roller 47, pressure rollers 49*a* and 49*b*, a printed-sheet space 50, and a controller 51.

The sheet container 41 contains a plurality of recording sheets 10. The recording sheets 10 contained in the sheet container 41 are urged to the sheet transfer roller 43 by a spring 53.

The sheet transfer roller 43 is placed in contact with the top sheet of the recording sheets 10 in the sheet container 41. The sheet transfer roller 43 is driven by a motor (not shown) based on control signals from the controller 51. Since the spring 53 produces a frictional force between the recording sheet 10 and the sheet transfer roller 43, when the sheet transfer roller 43 rotates, the top sheet of the recording sheets 10 is transferred toward the thermal head 45 with the frictional force. The controller 51 controls position and a feeding length of the recording sheet 10 by controlling the number of rotation of the motor (or sheet transfer roller 43) based upon the above-mentioned control signals.

The thermal head 45 is placed downstream of the sheet transfer roller 43 along the transferring path of the recording sheet 10. The thermal head 45 has a heating-element array that has a plurality of heating elements linearly arranged in the main scanning direction. The heating-element array of the thermal head 45 contacts the recording sheet 10 and heats each heating element according to the pattern of the image to be formed. In this embodiment, each heating element has at least three heating states, which are non-heating state, a low-temperature heating state, and a high-temperature heating state. The controller 51 selects one of the three states.

Heating temperature of each heating element is controlled by changing the period of current flowing through a resistance connected to each heating element. The controller 51 controls a pulse width of a strobe signal that defines the period of current flowing through each heating element, depending on the heating time.

The thermal head 45 may have a plurality of adjustable heating temperatures corresponding to gradation of an image data in the low-temperature color-forming state or the high-temperature color-forming state.

The platen roller 47 faces the thermal head 45 across the transferring path of the recording sheet 10. The platen roller 47 rotates according to transferring status of the recording sheet 10 and stabilizes the status of contact between the recording sheet 10 and the heating elements of the thermal head 45.

Downstream of the transferring path of the recording sheet 10, there is a pair of pressure rollers 49*a* and 49*b*.

The pressure rollers 49*a* and 49*b* sandwiches and pressures the recording sheet 10, which has been developed by the heated thermal head 45, in order to add a pressure to the low-temperature color-forming capsules 28 in the low-temperature color-forming layer 17, so that the low-temperature color inhibitor in the low-temperature color-inhibiting capsules 28 flows out of the capsules 28.

The pressure rollers 49*a* and 49*b* also have a function to transfer the recording sheet 10, which has been pressured already, back to the thermal head 45.

The printed-sheet space 50 is a space on the transferring path through which the recording sheet 10 is transferred to an exit (at the left side of FIG. 6).

The controller 51 is an electronic circuit such as a microprocessor unit and controls the operation of the printer 40.

Referring to FIGS. 6 to 8, the operation of the printer 40 will be described.

Step ST0

The printer 40 contains a plurality of the recording sheets 10 in the sheet container 41. The recording sheets 10 contained in the sheet container 41 are urged to the sheet transfer roller 43 by the spring 53, so that a frictional force occurs between the top sheet of the recording sheets 10 and the sheet transfer roller 43.

Step ST1

The controller 51 controls the sheet transfer roller 43 to transfer the top sheet of the recording sheets 10 contained in the sheet container 41 to the thermal head 45.

Step ST2

Under the control of the controller 51 the thermal head 45 heats the heating elements to a low-temperature according to the image pattern of pixels, which correspond to low-temperature color-forming components to be formed on the recording sheet 10. Thus the low-temperature color-forming layer 17 of the recording sheet 10 is heated to a low-temperature T1 as shown in FIG. 2 according to the image pattern of pixels, which are based on image information and correspond to low-temperature color-forming components to be formed on the recording sheet 10, so that the color former in the low-temperature color-forming capsules 27 located at the low heated points reacts with the color developer around the capsules 27, resulting in colors (low-temperature color-forming).

The controller 51 controls gradation of each color by changing heating time.

Step ST3

Following step ST2, the platen roller 47 transfers the recording sheet 10 to the pressure rollers 49*a* and 49*b* under the control of the controller 51. The recording sheet 10 is pressured at the breaking pressure P1 by the pressure rollers 49*a* and 49*b*. This pressure breaks the low-temperature color-inhibiting capsules 28 in the low-temperature color-forming layer 17, so that the low-temperature color inhibitor flows out of the capsules 28, inhibiting the reaction between the low-temperature color former and the color developer. As a result, the recording sheet 10 is fixed in the low-temperature color developing process.

Step ST4

Under the control of the controller 51 the pressure rollers 49*a* and 49*b* rotate in a direction reverse to that in the step ST3 and transfers the recording sheet 10 back to the thermal head 45.

Step ST5

Under the control of the controller 51 the thermal head 45 heats each heating element to a high-temperature according to the image pattern of pixels, which correspond to high-temperature color-forming components to be formed on the recording sheet 10. Thus the high-temperature color-forming layer 13 of the recording sheet 10 is heated to a high-temperature T3 as shown in FIG. 2 according to the image pattern of pixels, which are based on image information and correspond to high-temperature color-forming components to be formed on the recording sheet 10, so that the color former in the high-temperature color-forming capsules 23 located at the high heated points reacts with the color developer around the capsules 23, resulting in colors (high-temperature color-forming).

In this point, the low-temperature color-forming layer 17 does not form a color because it has been fixed already.

The controller 51 preferably sets the heating time of the high-temperature color forming shorter than that of the low-temperature color forming.

Step ST6

Under the control of the controller 51 the platen roller 47 and pressure rollers 49*a* and 49*b* are driven, and the recording sheet 10 is transferred to the exit, which is at the left side of FIG. 7, through the printed-sheet space 50.

As described above, in accordance with the present embodiment, since the recording sheet 10 is fixed by using a pressure and is not fixed with ultraviolet light, it is easy to preserve the recording sheet 10.

Further, since dyes are contained in the microcapsules within each layer of the recording sheet 10, they can well resist chemical and physical damage. The recording sheet 10, therefore, has excellent image stability.

Further in accordance with the present embodiment, the recording sheet 10 and the printer 40 do not need consumables such as ink cartridges and ink ribbons. Therefore, the recording sheet 10 and the printer 40 of the present embodiment can be maintained with ease and cheap running cost because ink cartridges and ink ribbons are not necessary. Further in accordance with the present embodiment, the recording sheet 10 and the printer 40 can be maintained without producing industrial wastes such as ink ribbons and ink cassettes.

Further in accordance with the present embodiment, the recording sheet 10 and the printer 40 have the advantage of security protection because printed information doesn't remain on a ribbon sheet unlike printers using ribbons.

In accordance with the present embodiment, as shown in FIG. 9, low-temperature color-forming capsules 27 may be included in low-temperature color-forming layer 17, and low-temperature color-inhibiting capsules 28 may be included in low-temperature color-inhibiting layer 60, which is in contact with the low-temperature color-forming layer 17. In this case, color developer and, if necessary, basic or acid substance may be contained in the low-temperature color-forming layer 17.

Second Embodiment

In the above-mentioned first embodiment, there are two types of color-forming capsules, which are used at low-temperatures and high-temperatures. In the present embodiment, there are three types of color-forming capsules, which are used at low-temperatures, medium-temperatures, and high-temperatures.

The present embodiment corresponds to claims 4, 5, and 12. The present embodiment corresponds to the case of N=3 in claim 4.

[Recording Sheet 110]

FIG. 10 is a schematic view of a recording sheet 110 in accordance with the second embodiment of the present invention.

As shown in FIG. 10, the recording sheet 110 includes, for example, a high-temperature color-forming layer 13, a mixing prevention layer 111, a medium-temperature color-forming layer 113, a mixing prevention layer 115, a low-temperature color-forming layer 17, and a protective layer 19, which are stacked up in order on a support sheet 11.

Referring to FIG. 10, the support sheet 11, the high-temperature color-forming layer 13, and the low-temperature color-forming layer 17 have the same number as those of FIG. 1.

Referring to FIG. 11, the low-temperature color-inhibiting capsules 28 in the medium-temperature color-forming layer 17 activates low-temperature color-inhibiting capability on condition that the capsules 28 are heated at temperature Ta (for example, 100° C.), which is lower than temperature Tb (for example, 130°) at which a medium-temperature capsule 123 activates medium-temperature color-inhibiting capability, and are pressured at breaking pressure P1.

Referring to FIG. 10, the recording sheet 110 includes a mixing prevention layer 111, the medium-temperature color-forming layer 113, and a mixing prevention layer 115 between the high-temperature color-forming layer 13 and the low-temperature color-forming layer 17, which are stacked up in order.

The medium-temperature color-forming layer 113 includes medium-temperature color-forming capsules 121, color developer, the medium-temperature color-inhibiting capsules 123, and, if necessary, basic or acid substance suspended in binder material. The medium-temperature color-forming capsules 121 include color former. A glass-transition point of the shell wall, for example, is in medium-temperatures between 150-280° and is higher than that of the low-temperature capsule 27 and lower than that of the high-temperature capsule 23.

When the medium-temperature color-forming layer 113 is, for example, at a medium-temperature higher than T2 (for example, 140°) as shown in FIG. 11, the color former in the medium-temperature capsule 121 reacts with the color developer in the medium-temperature color-forming layer 113, resulting in colors. Except for a glass-transition point of the shell wall, the color-forming principle of the medium-temperature color-forming capsule 121 is the same as those of the high-temperature color-forming capsule 23 and the low-temperature color-forming capsule 27. In this embodiment, in order to form a yellow color in the medium-temperature color-forming layer 113, the color former in the medium color-forming capsule 121 and the color developer in the medium color-forming layer 113 are selected.

If there is not a condition that temperature is higher than Tb (for example, 130°) and breaking pressure P1 is added, the low-temperature color-inhibiting capsules 123 are allowed to contain the medium-temperature color inhibitor that inhibits the color forming of the medium-temperature color-forming layer 113 as well as the case as shown FIG. 4(A).

If there is a condition that temperature is higher than Tb and breaking pressure P1 is added, the low-temperature color-inhibiting capsules 123 are broken (or permeable) and allow the medium-temperature color inhibitor to flow out of the capsules 123 as well as the case as shown FIG. 4(B).

The principle that the medium-temperature inhibitor inhibits the capability of the medium-temperature color-forming layer 113 is the same as the principle that the low-temperature color inhibitor inhibits the capability of the low-temperature color-forming layer 17 as described in the first embodiment.

In the low-temperature color-forming layer 17 according to the present embodiment, the color former in the low-temperature capsules 27 and the color developer in the low-temperature color-forming layer 17 are selected so as to form a yellow color. In the medium-temperature color-forming layer 113, the color former in the medium-temperature color-forming capsules 121 and the color developer in the medium-temperature color-forming layer 113 are selected so as to form a magenta color.

In the high-temperature color-forming layer 13, the color former in the high-temperature color-forming capsules 23 and the color developer in the high-temperature color-forming layer 13 are selected so as to form a cyan color. Any color can be assigned to each layer.

Referring to FIG. 12, the operation of printer 140 that records data on the recording sheet 110 is described.

The printer 140 is the same as the printer 40 shown in FIG. 6 except for part of operation.

Step ST20

A plurality of recording sheets 110 are contained in the sheet container 41 of the printer 140. The recording sheets 110 contained in the sheet container 41 are urged to the sheet transfer roller 43 by the force of the spring 53, so that a frictional force between top sheet of the recording sheets 110 and the sheet transfer roller 43 is created.

Step ST21

Under the control of the controller 51 the sheet transfer roller 43 rotates, transferring the top sheet of the recording sheets 110 to the thermal head 45.

Step ST22

Under the control of the controller 51 the thermal head 45 heats each heating element to a low-temperature according to the image pattern of pixels, which correspond to low-temperature color-forming components to be formed on the recording sheet 110. Thus the low-temperature color-forming layer 17 of the recording sheet 110 is heated to a low-temperature T1 as shown in FIG. 2 according to the image pattern of pixels, which are based on image information and correspond to low-temperature color-forming components to be formed on the recording sheet 110, so that the color former in the low-temperature color-forming capsules 27 located at the low heated points reacts with the color developer around the capsules 27, resulting in colors (low-temperature color-forming).

Step ST23

Following step ST22, the platen roller 47 transfers the recording sheet 110 to the pressure rollers 49*a* and 49*b* under the control of the controller 51. The recording sheet 110, as shown in FIG. 11, is pressured at a temperature Ta and at a breaking pressure P1 by the pressures roller 49*a* and 49*b*. This pressure breaks the low-temperature color-inhibiting capsules 28 in the low-temperature color-forming layer 17 as shown in FIG. 10, so that the low-temperature color inhibitor flows out of the capsules 28, inhibiting the reaction between the low-temperature color former and the color developer. As a result, the recording sheet 10 is fixed at a low-temperature.

Either of pressure rollers 49*a* and 49*b* is made from a metal and includes Nichrome wire for heating. In the present embodiment, in step ST26 the heating with the pressure rollers 49*a* and 49*b* is necessary as described later, but in step 23 the heating is not necessary if the temperature Ta is a room temperature.

Step ST24

Under the control of the controller 51, the pressure rollers 49*a* and 49*b* rotates in a direction reverse to that in the step ST23 and transfers the recording sheet 110 to the thermal head 45.

Step ST25

Under the control of the controller 51 the thermal head 45 heats the heating elements to a low-temperature according to the image pattern of pixels, which correspond to low-temperature color-forming components to be formed on the recording sheet 120. Thus the medium-temperature color-forming layer 113 of the recording sheet 110 is heated to a medium-temperature T2 as shown in FIG. 12 according to the image pattern of pixels, which are based on image information and correspond to medium-temperature color-forming components to be formed on the recording sheet 110, so that the color former in the medium-temperature color-forming capsules 121 located at the medium-temperature points reacts with the color developer around the capsules 121, resulting in colors (medium-temperature color forming).

In this point, the low-temperature color-forming layer 17 does not form a color because it has been fixed already. The controller 51 preferably sets the heating time of the medium-temperature color forming shorter than that of the low-temperature color forming.

Step ST26

Following step ST25, the platen roller 47 transfers the recording sheet 110 to the pressure rollers 49*a* and 49*b* under the control of the controller 51. The recording sheet 110, as shown in FIG. 11, is pressured at breaking pressure P1 by the pressure rollers 49*a* and 49*b* in the state of the temperature Tb.

In step ST26 the pressure rollers 49*a* and 49*b* add heat at the temperature Tb.

This breaks the medium-temperature color-inhibiting capsules 123 in the medium-temperature color-forming layer 113, so that the medium-temperature color inhibitor flows out of the capsules 123, inhibiting reaction between the medium-temperature color former and the color inhibitor. As a result, the fixation for the medium-temperature color forming is performed.

Step ST27

Under the control of the controller 51 the pressure rollers 49*a* and 49*b* rotates in a direction reverse to that in the step ST26 and transfers the recording sheet 110 to the thermal head 45.

Step ST28

Under the control of the controller 51 the thermal head 45 heats each heating element to a high-temperature according to the image pattern of pixels, which correspond to high-temperature color-forming components to be formed on the recording sheet 110. Thus the high-temperature color-forming layer 13 of the recording sheet 110 is heated to high-temperature T3 as shown in FIG. 11 according to the image pattern of pixels, which are based on image information and correspond to high-temperature color-forming components to be formed on the recording sheet 110, so that the color former in the high-temperature color-forming capsules 23 located at the high heated points reacts with the color developer around the capsules 23, resulting in colors (high-temperature color forming).

In this point, the low-temperature color-forming layer 17 and the medium-temperature color-forming layer 113 do not form a color because they have been fixed already. The controller 51 preferably sets the heating time of the high-temperature color forming shorter than that of the low-temperature color forming.

Step ST29

Under the control of the controller 51 the platen roller 47 is driven, and the recording sheet 110 is transferred to the exit, which is at the left side of FIG. 6, through the printed-sheet space 50.

As described above, the recording sheet 110 and the printer 140 enable the color forming of cyan, magenta, and yellow.

Further in accordance with the present embodiment, the recording sheet 110 and the printer 140 have the effects described in the first embodiment as well.

In the present embodiment, for example, as described in FIG. 13, the low-temperature capsules 27 may be placed in the low-temperature color-forming layer 223, and the low-temperature inhibiting capsules 28 may be placed in the low-temperature inhibiting layer 221, which is in contact with the low-temperature color-forming layer 223.

Further as described in FIG. 13 the medium-temperature color-forming capsules 121 may be placed in the medium-temperature color-forming layer 217, and the medium-temperature color-inhibiting capsules 123 may be placed in the medium-temperature color-inhibiting layer 215, which is in contact with medium-temperature color-forming layer 217.

Third Embodiment

In the second embodiment as described above, as shown in FIG. 10, the high-temperature color-forming layer 13, the medium-temperature color-forming layer 113, and the low-temperature color-forming layer 17 are stacked up in order from the support sheet 11 toward the protective layer 19 (heating side). However, in the present embodiment, as shown in FIG. 14, the low-temperature color-forming layer 17, the medium-temperature color-forming layer 113, and the high-temperature color-forming layer 13 are stacked up in order from the support sheet 11 toward the protective layer 19.

The present embodiment corresponds to claims 4, 6, and 12.

FIG. 14 is a schematic view of a recording sheet 210 in accordance with the third embodiment of the present embodiment.

As shown in FIG. 14, the recording sheet 210 includes, for example, the low-temperature color-forming layer 17, a mixing prevention layer 219, the medium-temperature color-forming layer 113, a mixing prevention layer 213, the high-temperature color-forming layer 13, and the protective layer 19, which are stacked up in order.

In FIG. 14, the support sheet 11, which is denoted by the same reference numeral in FIGS. 1 and 10, the high-temperature color-forming layer 13, the low-temperature color-forming layer 17, the medium-temperature color-forming layer 113, and the protective layer 19 are the same as those described in the first embodiment and the second embodiment.

Referring to FIG. 11, low-temperature color-inhibiting capsules 28 in the low-temperature color-forming layer 17 activates the low-temperature color-inhibiting capability on condition that the capsules 28 are at temperature Ta, which is lower than the temperature Tb at which medium-temperature capsule 123 activates medium-temperature color-inhibiting capability, and are pressured at breaking pressure P1.

As shown in FIG. 14, the recording sheet 210 has the feature that the low-temperature color-forming layer 17 is paced on the support sheet 11 and the protective layer 19 is placed on the high-temperature color-forming layer 13.

The operation of the printer to record data on the recording sheet 210 as shown in FIG. 14 is the same as the operation of the printer 140 in the second embodiment as described in FIG. 12. However, since the low-temperature color-forming layer 17 is on the support-sheet 11 (it is distant from the top surface of the recording sheet 210), heating operation at a low-temperature in Step 22, as shown in FIG. 12, takes longer time than that of the second embodiment.

In accordance with this embodiment of the present invention, the recording sheet 210 and the printer have the same effects as those of the first and second embodiments.

Further with regard to the recording sheet 210 and the printer in the present embodiment, since the high-temperature color-forming layer 13 is placed next to the protective layer 19, the heating energy of developing color is decreased, so that energy efficiency becomes higher.

Fourth Embodiment

The present embodiment in accordance with the present invention corresponds to claims 4, 7, 8, and 13.

In the above-mentioned second embodiment, layers such as the high-temperature color-forming layer 13, the medium-temperature color-forming layer 113, and the low-temperature color-forming layer 17 are stacked up in order from the support sheet 11 toward the protective layer 19 (heating side). However, in the present embodiment as shown in FIG. 15, layers such as the medium-temperature color-forming layer 217, heat barrier layer 321, the low-temperature color-inhibiting layer 221, the low-temperature color-forming layer 223, the mixing prevention layer 219, the high-temperature color-forming layer 211, and the protective layer 19 are stacked up in order from the support sheet 11 toward the protective layer 19.

In FIG. 15, the support sheet 11, which is denoted by the same reference numeral in FIGS. 1, 10, and 13, layers such as the medium-temperature color-forming layer 217, the low-temperature color-inhibiting layer 221, the low-temperature color-forming layer 223, the mixing prevention layer 219, the high-temperature color-forming layer 211, and the protective layer 19 are the same as those described in the first, second, and third embodiments.

A recording sheet 310 does not include the medium-temperature color-inhibiting capsules 123, unlike the case of the FIGS. 10 and 13. In the recording sheet 310 the low-temperature color-inhibiting capsule 28 is the only color-inhibiting component. Therefore, although the fixation of the low-temperature color forming is performed, the fixation of the medium-temperature color forming is not performed.

Further, referring to FIG. 15, in the recording sheet 310, the low-temperature color-inhibiting layer 221 and the low-temperature color-forming layer 223 are placed between the medium-temperature color-forming layer 217 and the high-temperature color-forming layer 211. Further, the heat barrier layer 321 is placed between the medium-temperature color-forming layer 217 and the low-temperature color-inhibiting layer 221.

Since the low-temperature color-inhibiting layer 221 and the low-temperature color-forming layer 223 are placed between the medium-temperature color-forming layer 217 and the high-temperature color-forming layer 211 in the recording sheet 310, the printer enables color printing by performing the following operations.

FIG. 16 is a flow chart illustrating an example of the printer operation to form an image on the recording sheet 310 as shown in the FIG. 15.

Step ST30

The sheet container 41, as shown in FIG. 6, contains a plurality of the recording sheets 310. The recoding sheets 310 contained in the sheet container 41 are urged to the sheet transfer roller 43 by the spring 53, so that a frictional force is created between the top recording sheet 310 and the sheet transfer roller 43.

Step ST31

Under the control of the controller 51, the sheet transfer roller 43 rotates and the top recording sheet 310 contained in the sheet container 41 is transferred to the thermal head 45.

Step ST32

Under the control of the controller 51, the thermal head 45 heats the heating elements to a low-temperature according to the image pattern of pixels, which correspond to low-temperature color-forming components to be formed on the recording sheet 310. Thus the low-temperature color-forming layer 223 of the recording sheet 310 is heated to a low-temperature T1 as shown in FIG. 17 according to the image pattern of pixels, which are based on image information and correspond to low-temperature color-forming components to be formed on the recording sheet 310, so that the color former in the low-temperature color-forming capsules 27 located at the low heated points reacts with the color developer around the capsules 27, resulting in colors (low-temperature color-forming).

Step ST33

Following the step ST32, under the control of the controller 51 the platen roller 47 transfers the recording sheet 310 to the pressure rollers 49*a* and 49*b*. As shown in FIG. 17, the recording sheet 310 is at temperature Ta and is pressured at pressure P1 by the pressure rollers 49*a* and 49*b*. This pressure breaks the low-temperature color-inhibiting capsules 28 in the low-temperature color-inhibiting layer 221, so that the low-temperature color inhibitor flows out of the capsules 28, inhibiting the reaction between the low-temperature color former and the color developer in the low-temperature color-forming layer 223. As a result, the fixation is performed in the low-temperature color-forming process. If the temperature Ta is a room temperature, heating by the pressure rollers 49*a* and 49*b* in the step ST33 is unnecessary.

Step ST34

Under the control of the controller 51 the pressure rollers 49*a* and 49*b* rotates in the direction reverse to that in the step ST33 and transfers the recording sheet 310 to the thermal head 45.

Step ST35

Under the control of the controller 51 the thermal head 45 heats each heating element to a high-temperature according to the image pattern of pixels, which correspond to high-temperature color-forming components to be formed on the recording sheet 310. Thus the high-temperature color-forming layer 211 of the recording sheet 310 is heated to a high-temperature T3 as shown in FIG. 17 according to the image pattern of pixels, which are based on image information and correspond to high-temperature color-forming components to be formed on the recording sheet 310, so that the color former in the high-temperature color-forming capsules 23 located at the high heated points reacts with the color developer around the capsules 23, resulting in colors (high-temperature color-forming).

In the printer of the present embodiment, the heating time of the high-temperature color forming is preferably shorter than that of the medium-temperature color forming that will be performed later. In this case, between the high-temperature color-forming layer 211 and the medium-temperature color-forming layer 217, there are the mixing prevention layer 219, the low-temperature color-forming layer 223, the low-temperature color-inhibiting layer 221, and the heat barrier layer 321, which amount to a large thickness. Accordingly, if the high heating time is shorter, since the heat transfer time of the heat barrier layer 321 delays heat transmission (delay time effect), the high-temperature color-forming layer 211 can be developed without allowing the medium-temperature color-forming layer 217 to be developed. As a result, the fixation becomes unnecessary.

Step ST36

Under the control of the controller 51 the thermal head 45 heats each heating element to a high-temperature according to the image pattern of pixels, which correspond to high-temperature color-forming components to be formed on the recording sheet 310. Thus the medium-temperature color-forming layer 217 of the recording sheet 310 is heated to the medium-temperature T2 as shown in FIG. 17 according to the image pattern of pixels, which are based on image information and correspond to medium-temperature color-forming components to be formed on the recording sheet 310, so that the color former in the medium-temperature color-forming capsules 121 located at the medium heated points reacts with the color developer around the capsules 121, resulting in colors (medium-temperature color forming).

In the printer of the present embodiment, the heating time of medium-temperature color forming is longer than that of high-temperature color forming. Referring the steps ST 35 and 36, the thermal head 45 as shown in FIG. 6 can continuously perform the medium-temperature color forming and the high-temperature color forming by controlling temperature and time of the single thermal head.

Step ST37

Under the control of the controller 51 the platen roller 47 and pressure rollers 49*a* and 49*b* rotate and transfer the recording sheet 310 to the exit at the left side of FIG. 6.

In the recording sheet 310 as described above, between the high-temperature color-forming layer 211 and the medium-temperature color-forming layer 217, there are the mixing prevention layer 219, the low-temperature color-forming layer 223, the low-temperature color-inhibiting layer 221, and the heat barrier layer 321, which amount to a large thickness. Accordingly, it is not necessary to place the color-inhibiting layer of the medium-temperature color-forming layer 217, so that the structure of the recording sheet can be made simple.

Further with regard to the printer of the present embodiment, since the fixation of the medium-temperature color-forming layer 217 is not necessary, the thermal head 45 as shown in FIG. 6 can continuously perform the medium-temperature color forming and the low-temperature color forming by controlling time and temperature of the single thermal head.

In above-mentioned example of FIG. 15, although the low-temperature color-inhibiting layer 221 and the low-temperature color-forming layer 223 are placed in the middle part of the recording sheet, the low-temperature color-inhibiting layer 221 and the low-temperature color-forming layer 223, for example, may be placed on the side of the protective layer 19, as shown in FIG. 18. In this case, since the heat barrier 321 is placed between the medium-temperature color-forming layer 217 and the high-temperature color-forming layer 211, the color inhibitor of the medium-temperature color-forming layer 217 is not necessary.

[First Modification to the Printer]

In the above-mentioned embodiments, as shown in FIG. 6, although each of pressure rollers 49*a* and 49*b* and the thermal head 45 works individually, the heating side of a thermal head 545 may also pressure the recording sheet 10, for example, as shown in FIG. 19.

Referring to FIG. 19, the thermal head 545 is fixed on one end of a lever 520. The lever 520 is rotatable around a shaft 520*a*. The other end of the lever 520 is urged by a spring 541 around the shaft 520*a* in a counterclockwise direction. A force of the spring 541 urges the heating side of the thermal head 545 to the recording sheet 10 with a normal pressure.

A lever 521 is rotatable around a shaft 520*a* and one end 521*a* of the lever 521 is in contact with one side of the lever 520.

The other end 521*b* of the lever 521 is in contact with a periphery of a cam 530. One end of a spring 540 is attached to the lever 521. When the cam 530 rotates, the lever 521 rotates predetermined degrees clockwise and counterclockwise around the shaft 520*a* depending on a radius difference of the cam 530.

When the lever 521 rotates fully in a clockwise direction, the end 521*a* does not pressure the lever 520. In this point, a force of the spring 540 does not act on the thermal head 545.

When the lever 521 rotates fully in a counterclockwise direction, the end 521*a* pushes the lever 520 and a force of the spring 540 urges the thermal head 545 against the recording sheet 10. This force makes the thermal head 545 pressure the recording sheet 10 with a breaking pressure.

In the printer shown in FIG. 19, the controller 51 controls the rotation of the cam 530 so that the heating side of the thermal head 545 can control the pressure onto the recording sheet 10.

According to the printer of the present embodiment, since a single thermal head can apply a plurality of heating temperatures and pressures to the recording sheet 10, the printer can form an image by passing through one process. That is, the printer can form an image by simply making the thermal head pass on the recording sheet 10 during one cycle. The use of a single thermal head leads to cost reduction because the thermal head is expensive and also to shrink a printer.

When a single linear thermal head is used, the conventional TA method printer needs to use the thermal head during two cycles of transferring the sheet, so that forming an image needs to take longer time. Further the TA method printer needs a ultraviolet lamp and a means of switching two types of filters, resulting in a large printer. The printer of the present embodiment can solve these problems.

[Second Modification to the Printer]

According to the printer of the present embodiment, as shown in FIG. 20, further thermal head 145 and platen roller 147 may be placed downstream from the pressure rollers 49*a* and 49*b* in a direction to transfer a recording sheet such as 10, 110, 210, or 310.

By doing this, it is possible for the thermal head 145 to perform high-temperature heating as soon as the low-temperature fixation has been finished, so that image-forming time can be made shorter.

[Third Modification to a Printer]

According to the printer of the present embodiment, as shown in FIG. 21, further pressure rollers 149*a* and 149*b* and further thermal head 245 and platen roller 247 may be placed downstream from the thermal head 145 and the platen roller 147.

By doing this, it is possible to serially perform the first heating process and the first pressuring process, the second heating process and the second pressuring process, and third heating process in order.

The present invention is not limited to only above-mentioned embodiments.

It will be appreciated by those skilled in the art that various modifications, combinations, subcombinations, and substitutions may be made in these embodiments without departing from the principles and spirit of the invention, the scope of which is defined in the claims and their equivalents.

For example, in the above-mentioned embodiments, although the recording sheet uses two colors or three colors in order to form a color, the recording sheet may use four colors to form a color. For example, four colors of yellow, cyan, magenta, and black may be used to form a color, or five colors of yellow, cyan, light cyan, magenta, and light magenta may be used to form a color.

In the above-mentioned embodiments of the present invention, although the thermal recording medium is a form of sheet, forms other than a sheet may be used.

INDUSTRIAL APPLICABILITY

The present invention is preferable as a recording system that records onto a thermal sheet.

EXPLANATION OF LETTERS AND NUMERALS

Figure 1:
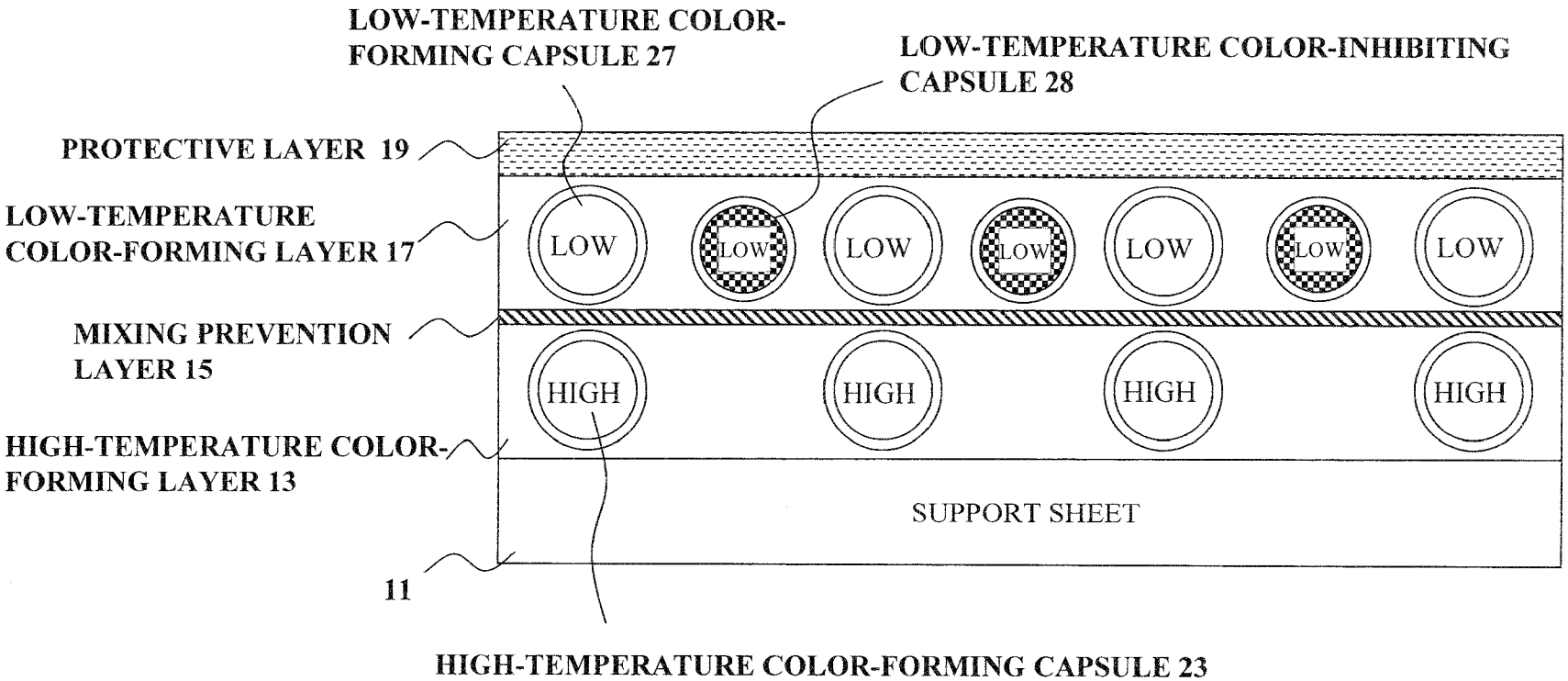
FIG. 1 is a schematic view of a recording sheet in accordance with the first embodiment of the present invention.
Figure 2:
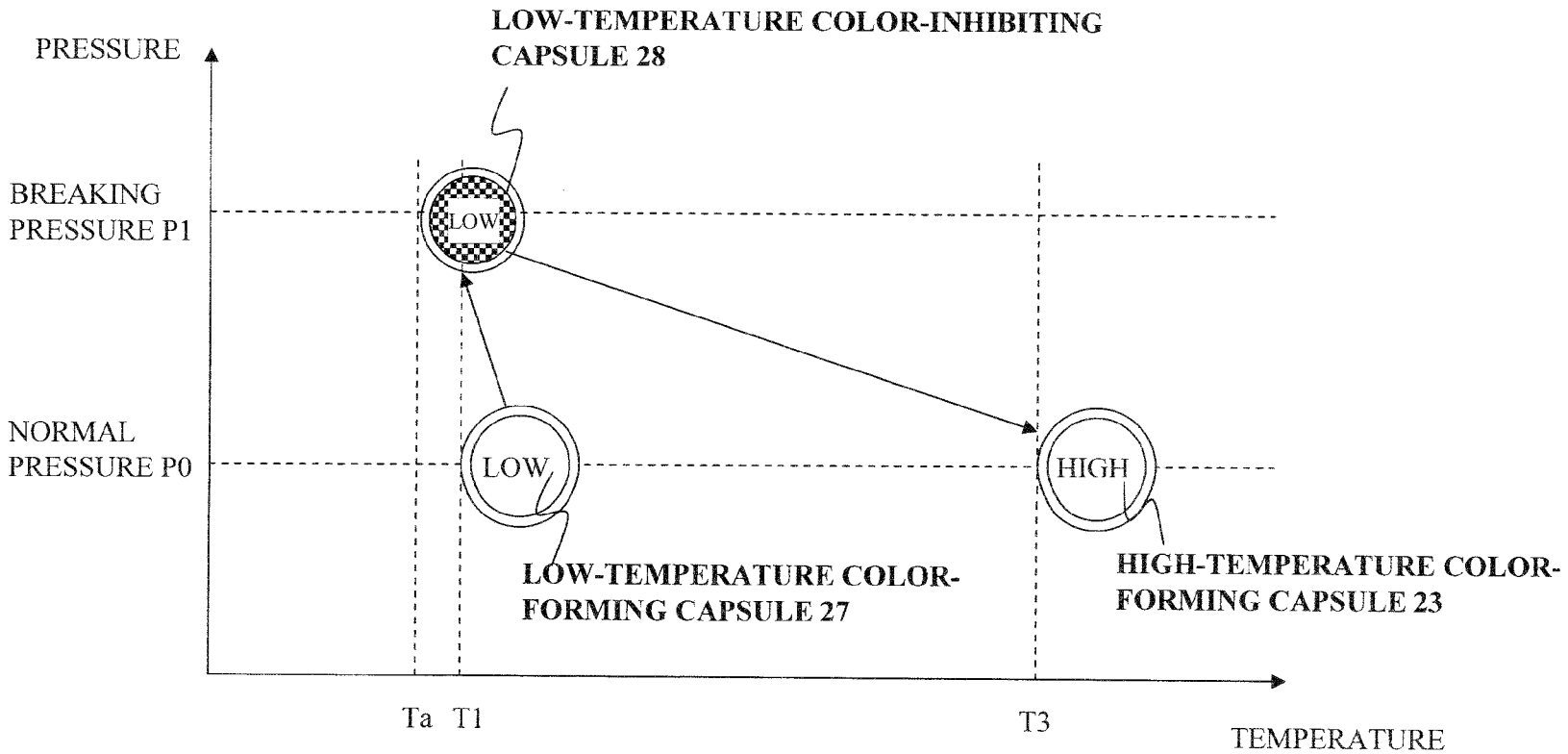
FIG. 2 is a schematic diagram of characteristics of a high-temperature color-forming capsule, a low-temperature color-forming capsule, and a low-temperature color-inhibiting capsule of the recording sheet as shown in FIG. 1.
Figure 3:
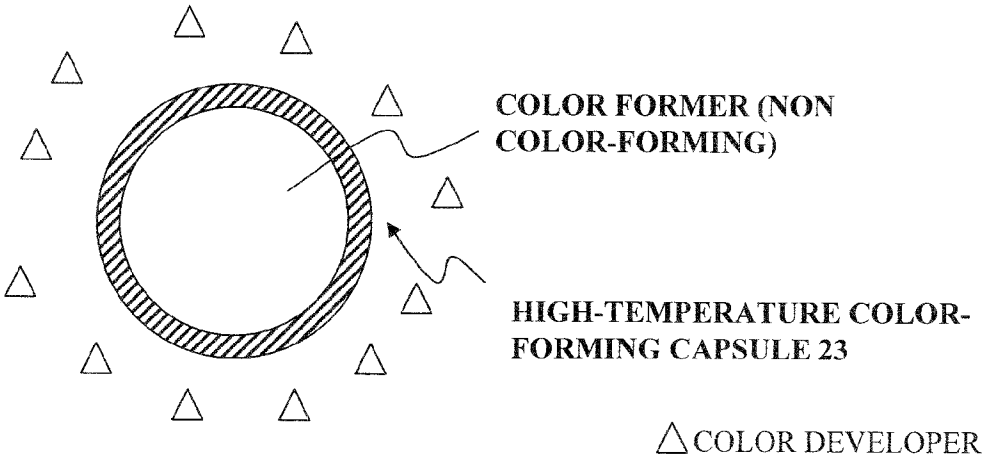
FIG. 3 is a schematic diagram illustrating a principle of color forming of a color-forming capsule as shown in FIG. 1.
Figure 3:
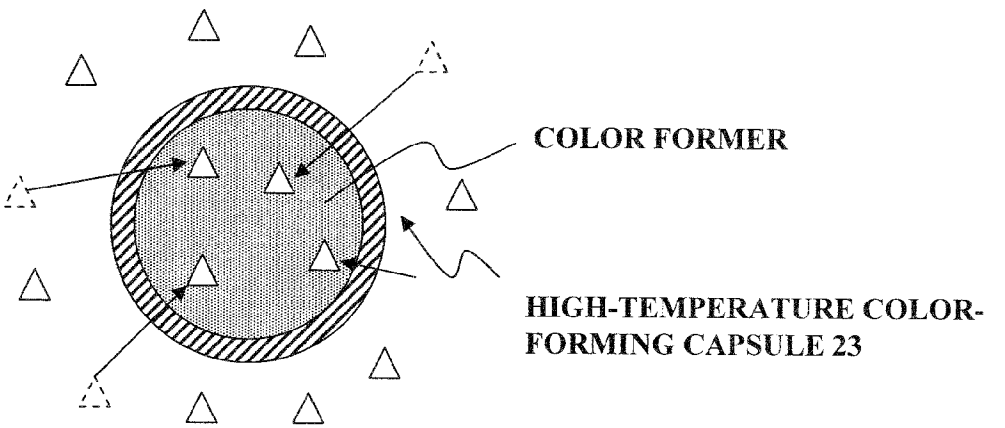
Figure 4:
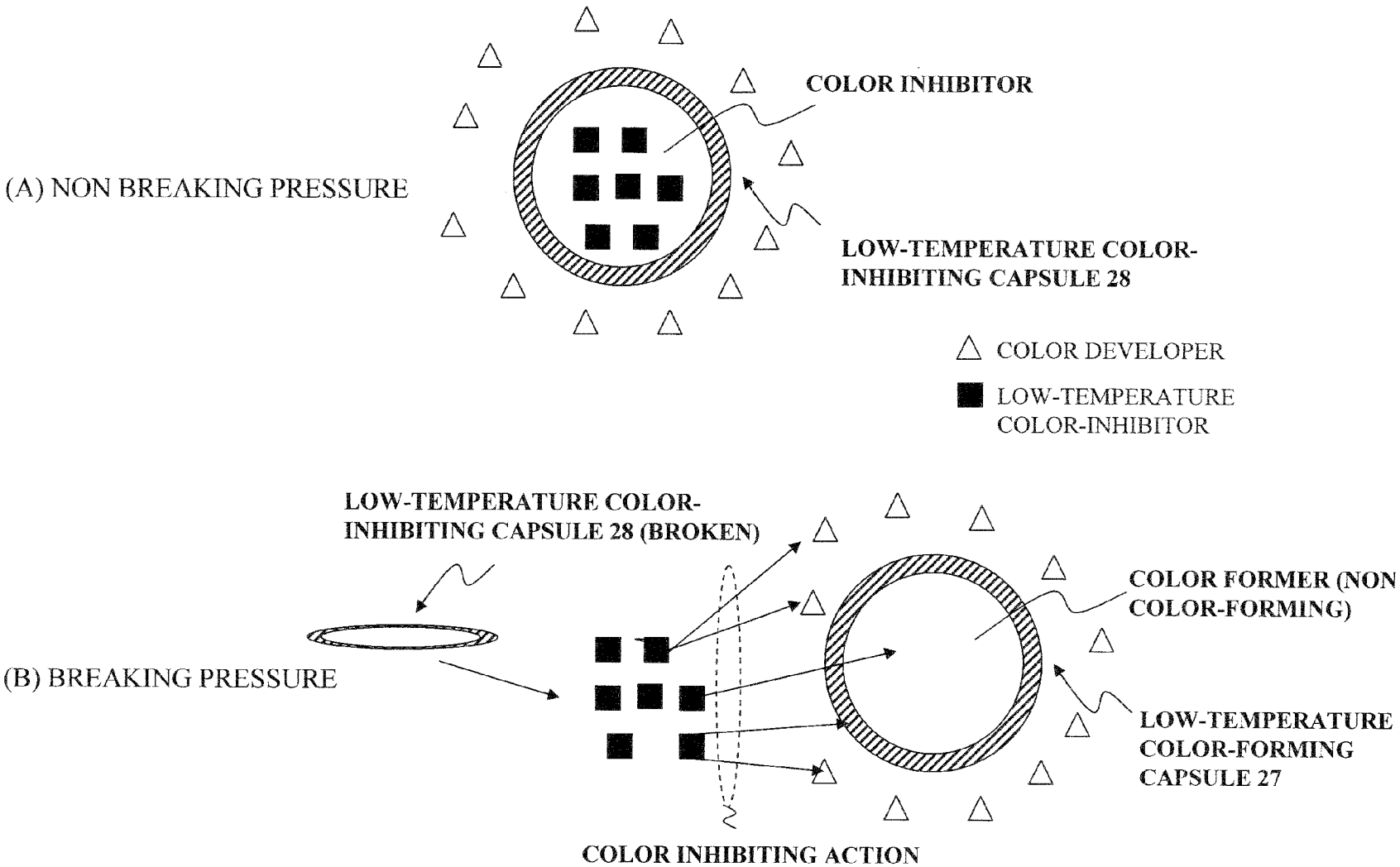
FIG. 4 is a schematic diagram illustrating color-forming inhibiting action of a low-temperature color-inhibiting capsule as shown in FIG. 1.
Figure 5:
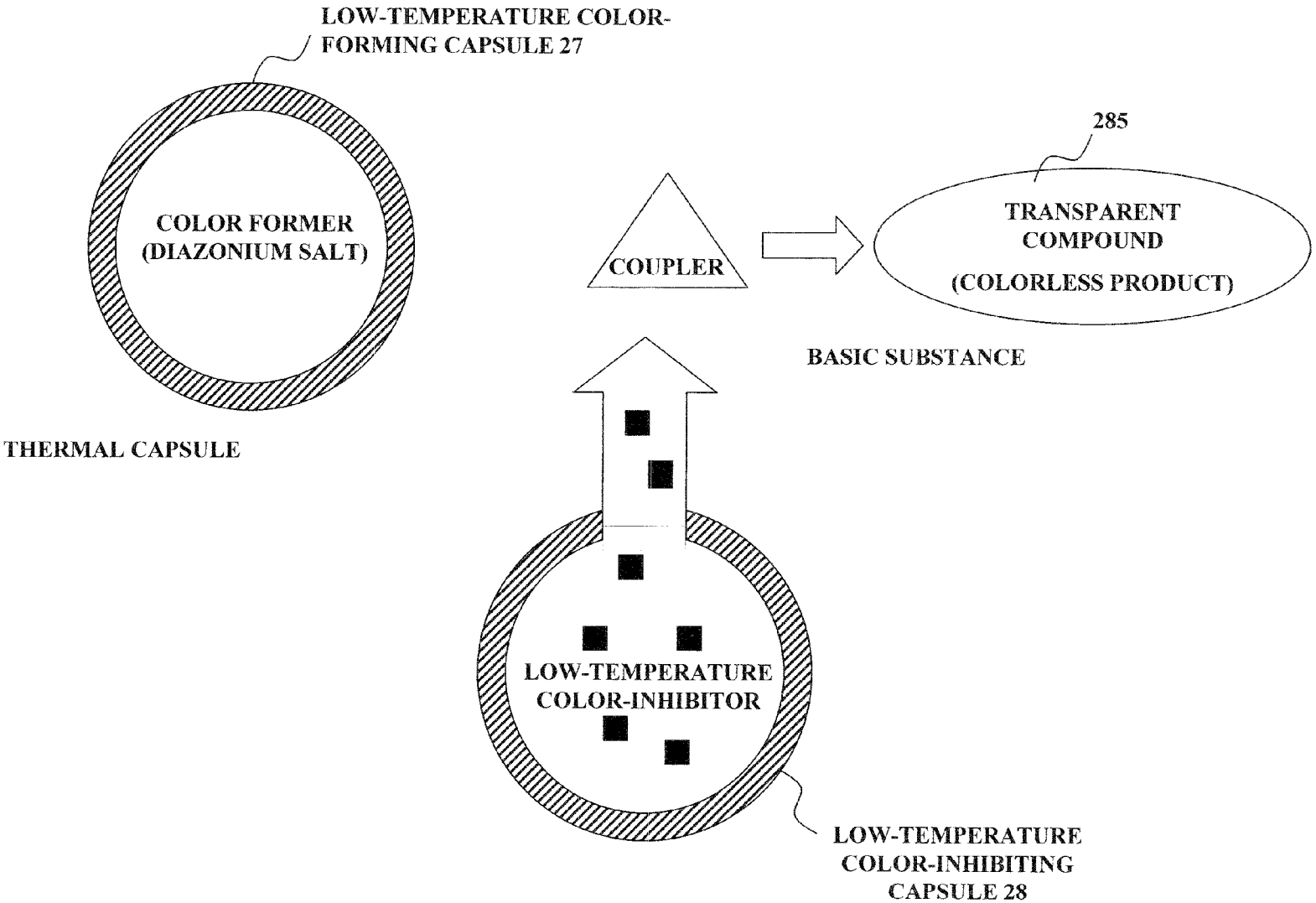
FIG. 5 is a schematic diagram illustrating color-forming inhibiting action of the color inhibitor as shown in FIG. 1.
Figure 6:
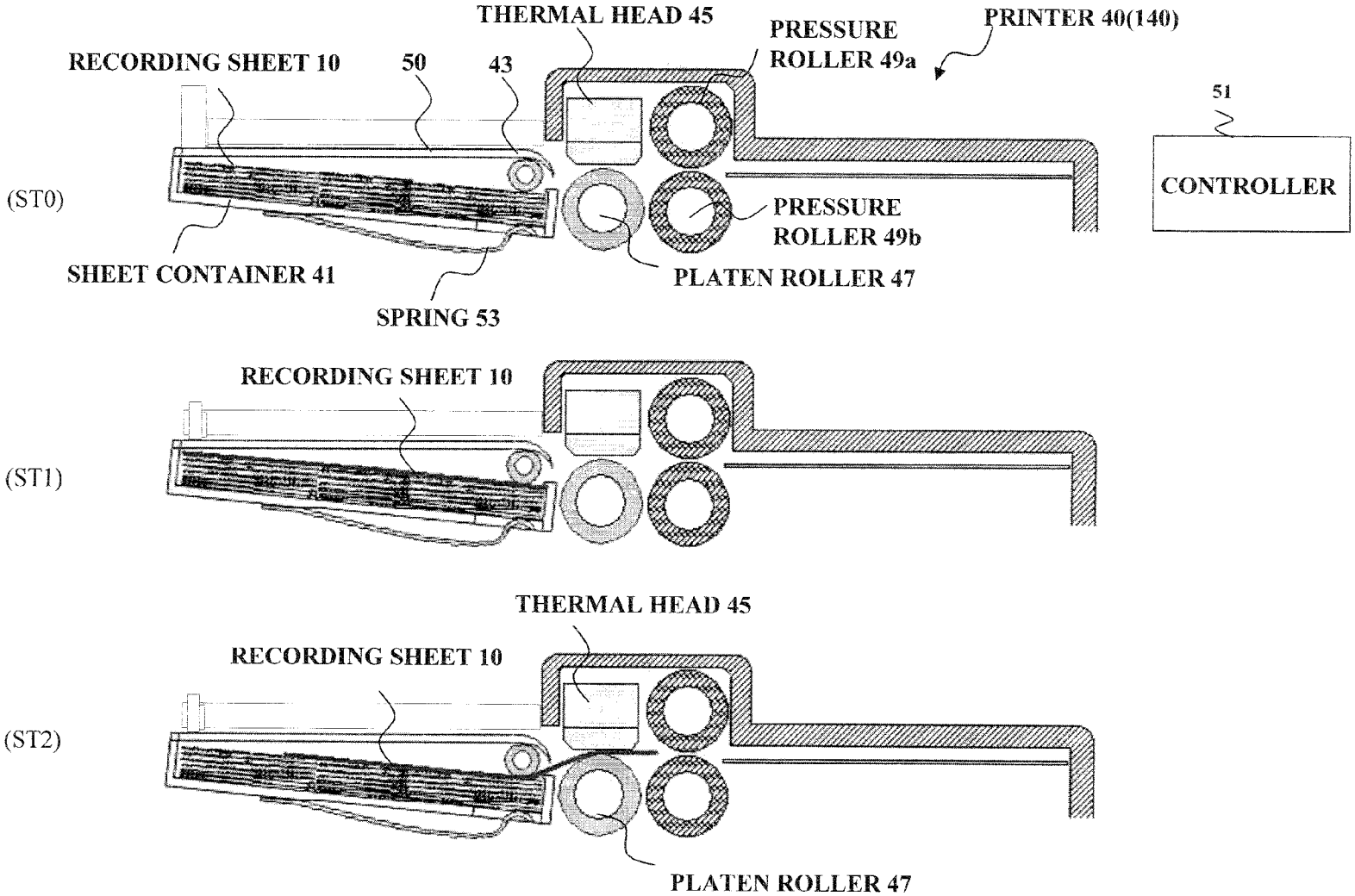
FIG. 6 is a cross-sectional view illustrating image forming operations of the printer in accordance with the first embodiment of the present invention.
Figure 7:
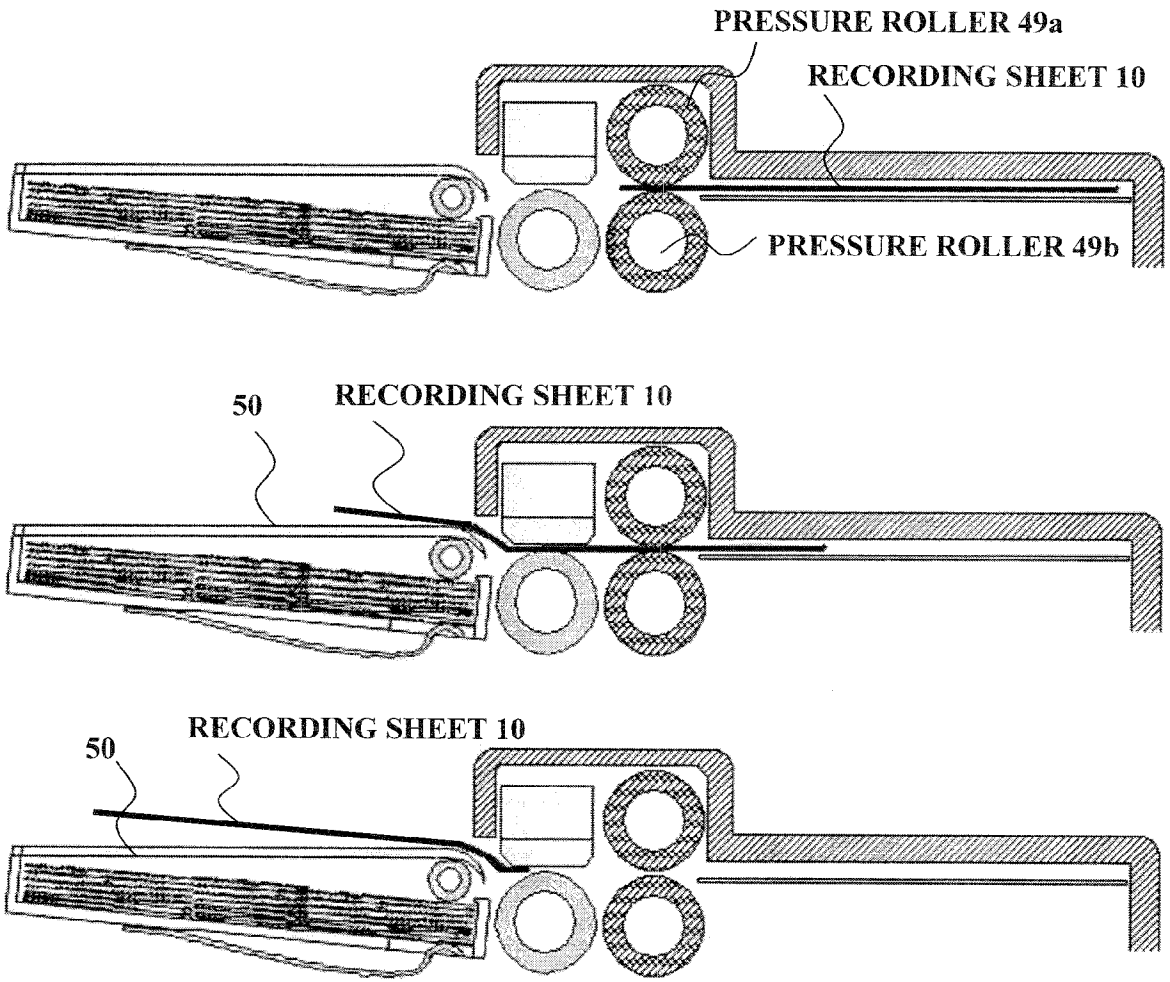
FIG. 7 is a cross-sectional view illustrating image forming operations of the printer, followed by FIG. 6, in accordance with the first embodiment of the present invention.
Figure 8:
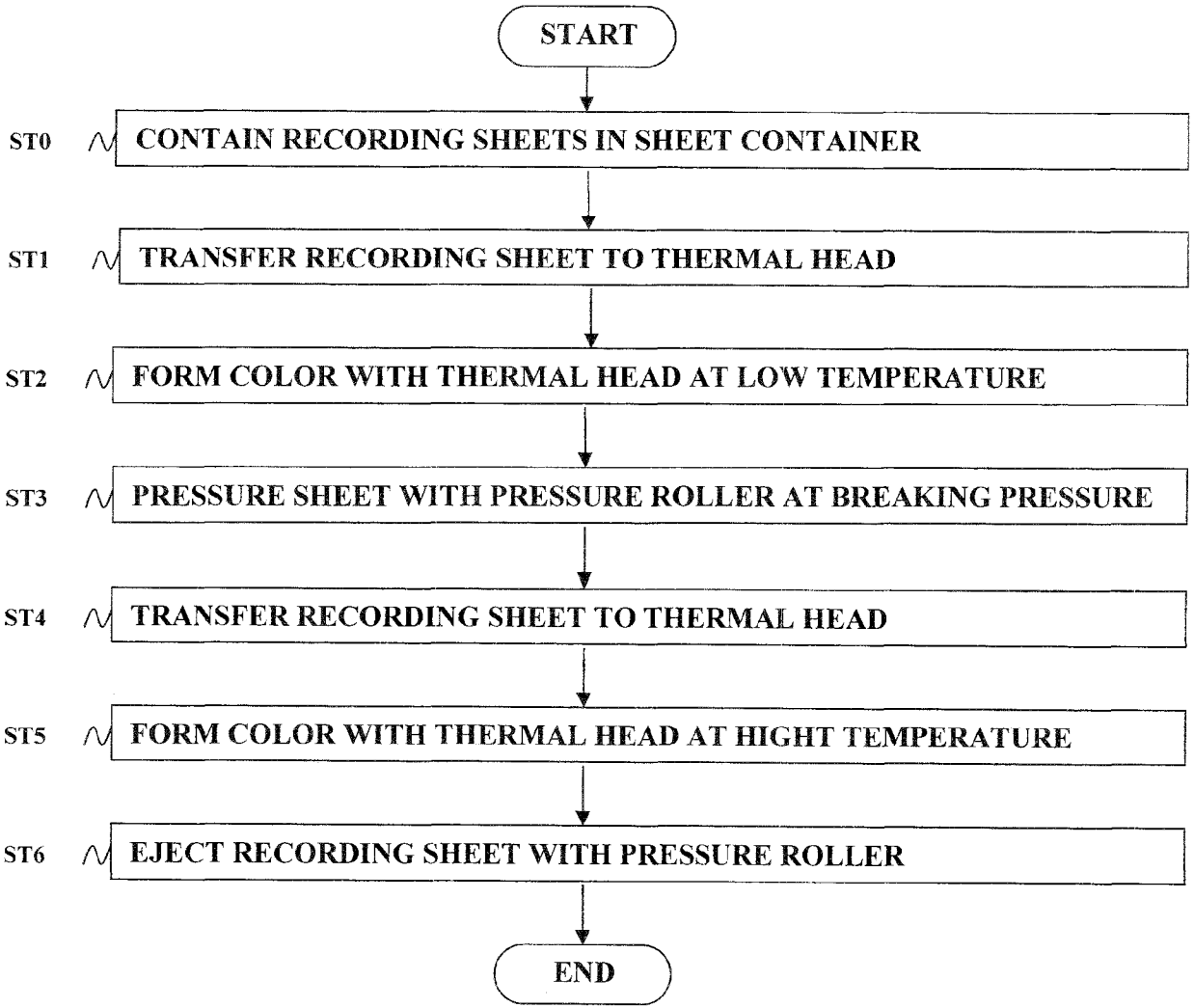
FIG. 8 is a flow chart illustrating image forming operations of the printer in accordance with the first embodiment of the present invention.
Figure 9:
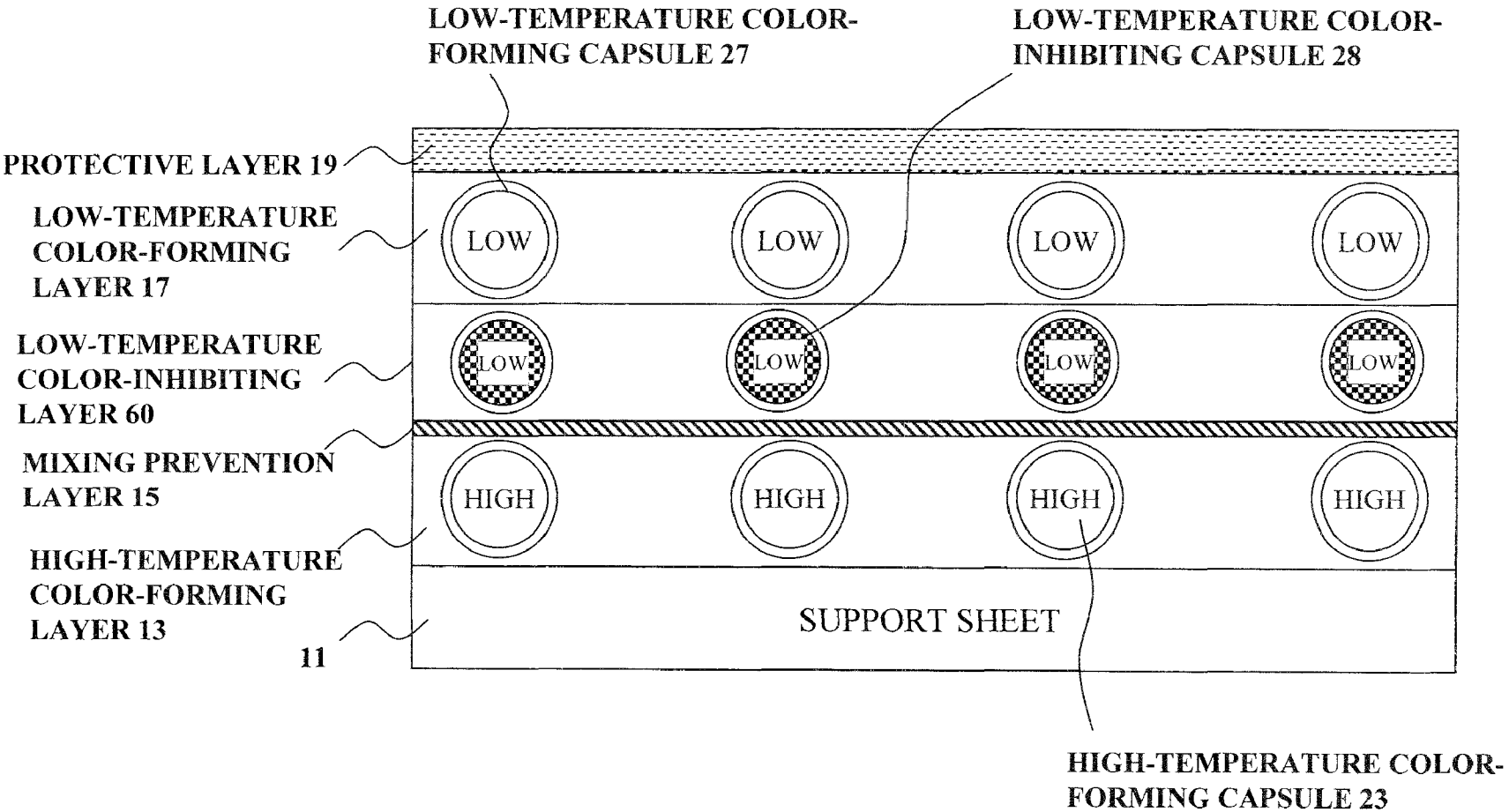
FIG. 9 is a schematic view of a modification to the recording sheet in accordance with the first embodiment of the present invention.
Figure 10:
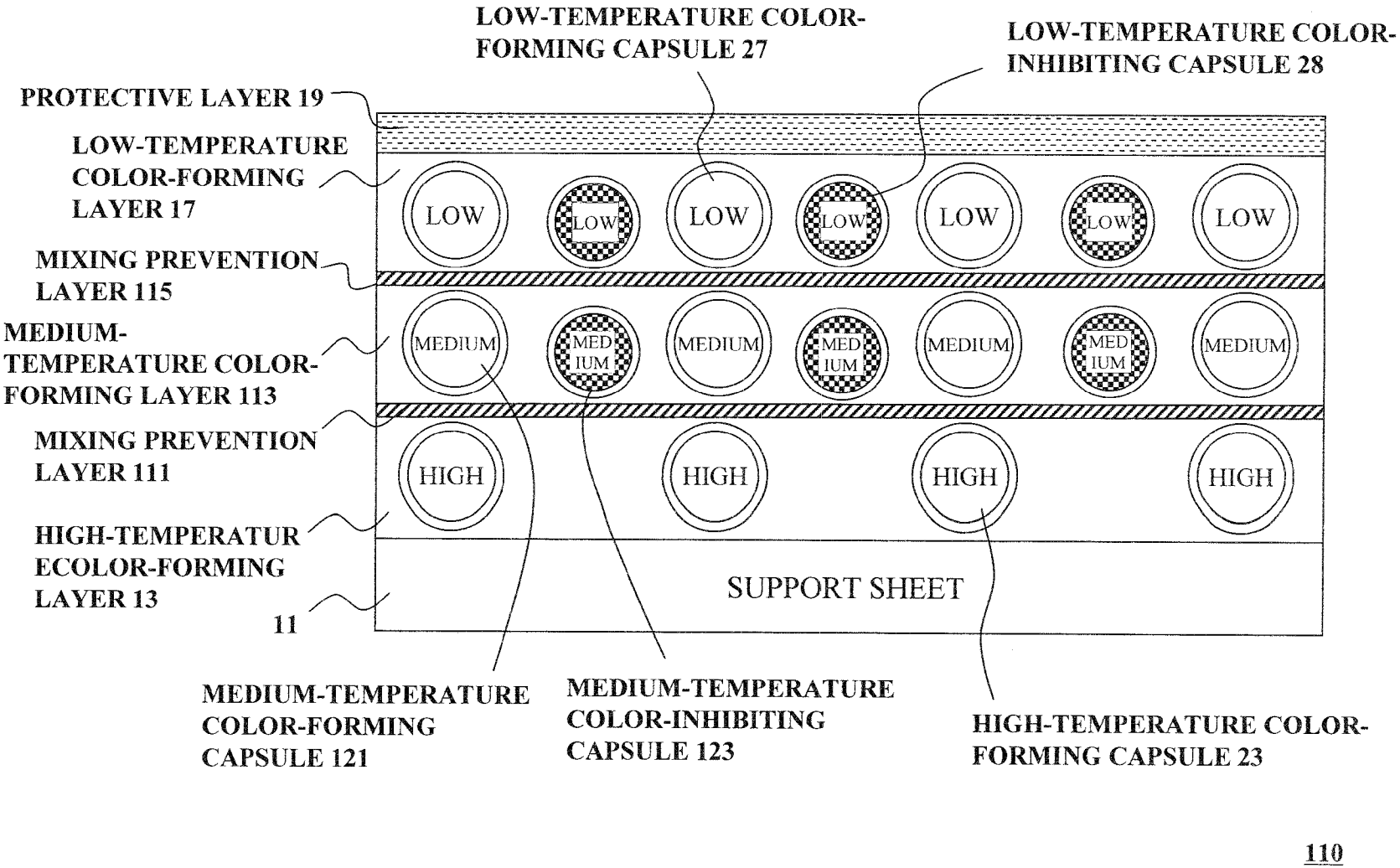
FIG. 10 is a schematic view of a recording sheet in accordance with the second embodiment of the present invention.
Figure 11:
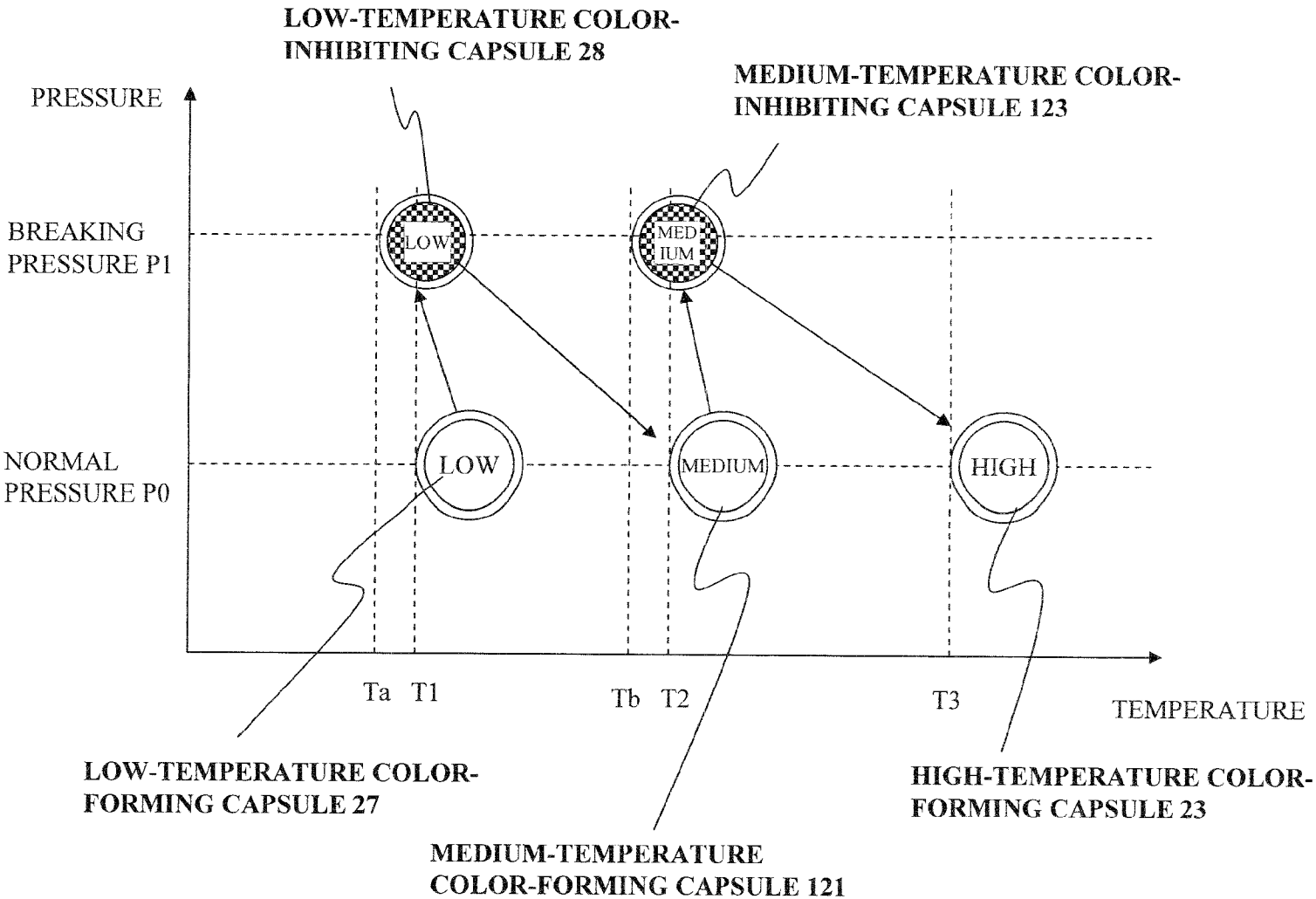
FIG. 11 is a schematic diagram illustrating characteristics of capsules such as a high-temperature color-forming capsule, a medium-temperature color-forming capsule, a low-temperature color-forming capsule, a low-temperature color-inhibiting capsule, and a medium-temperature color-inhibiting capsule, which are included in the recording sheet as shown in FIG. 10.
Figure 12:
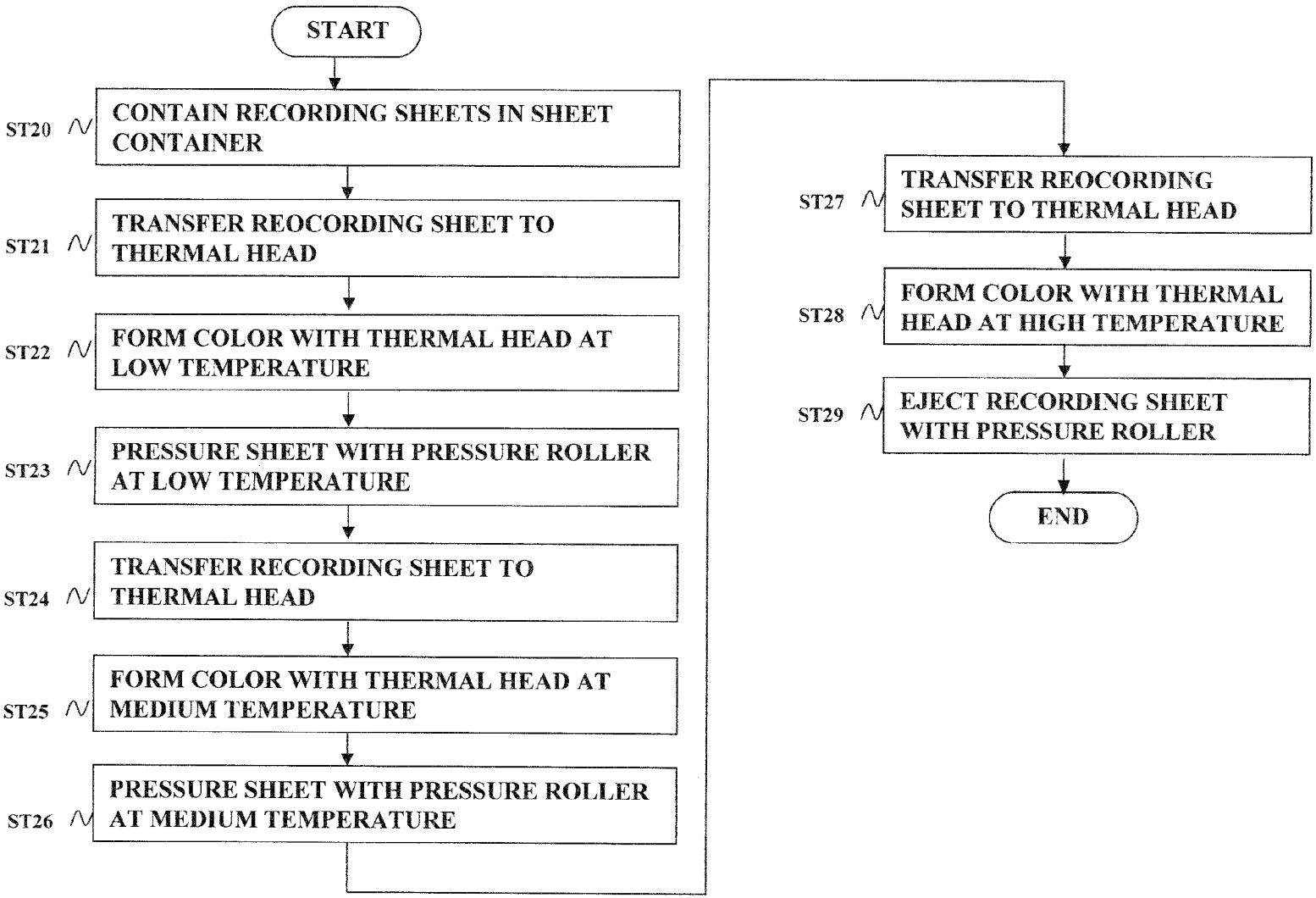
FIG. 12 is a flow chart illustrating image-forming operations of the printer in accordance with the second embodiment of the present invention.
Figure 13:
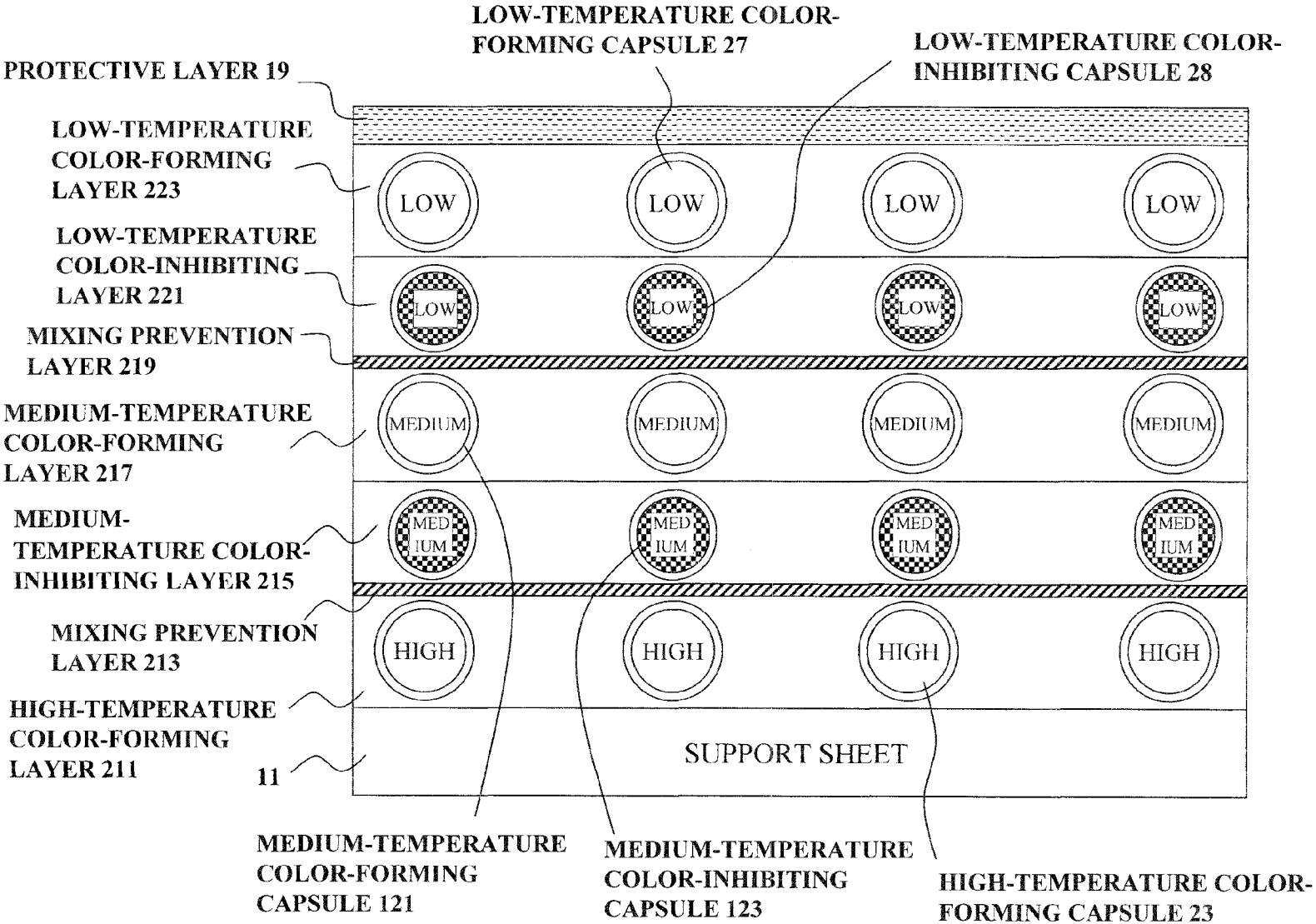
FIG. 13 is a schematic view of a modification to the recording sheet in accordance with the second embodiment of the present invention.
Figure 14:
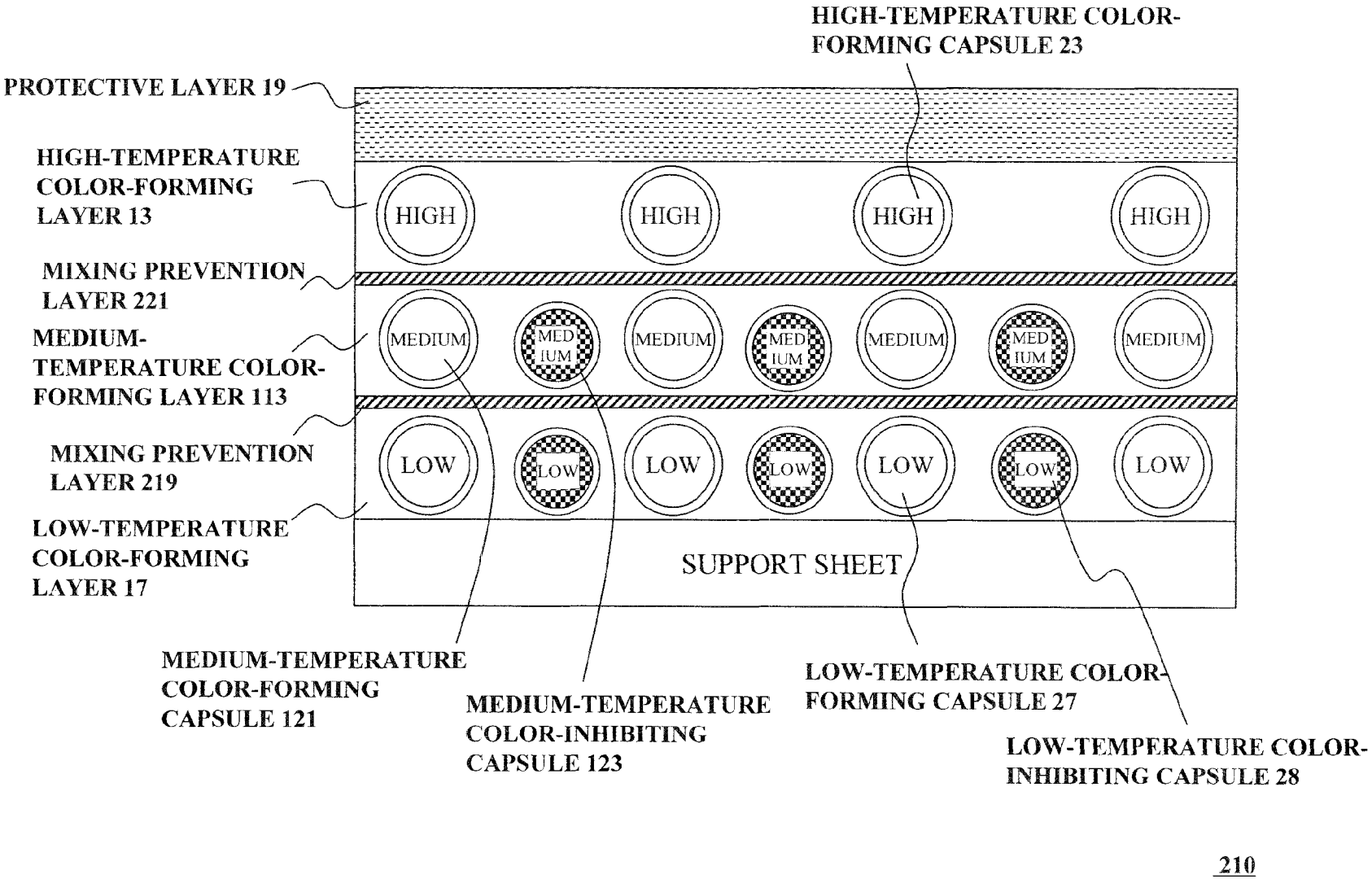
FIG. 14 is a schematic view of a recording sheet in accordance with the third embodiment of the present invention.
Figure 15:
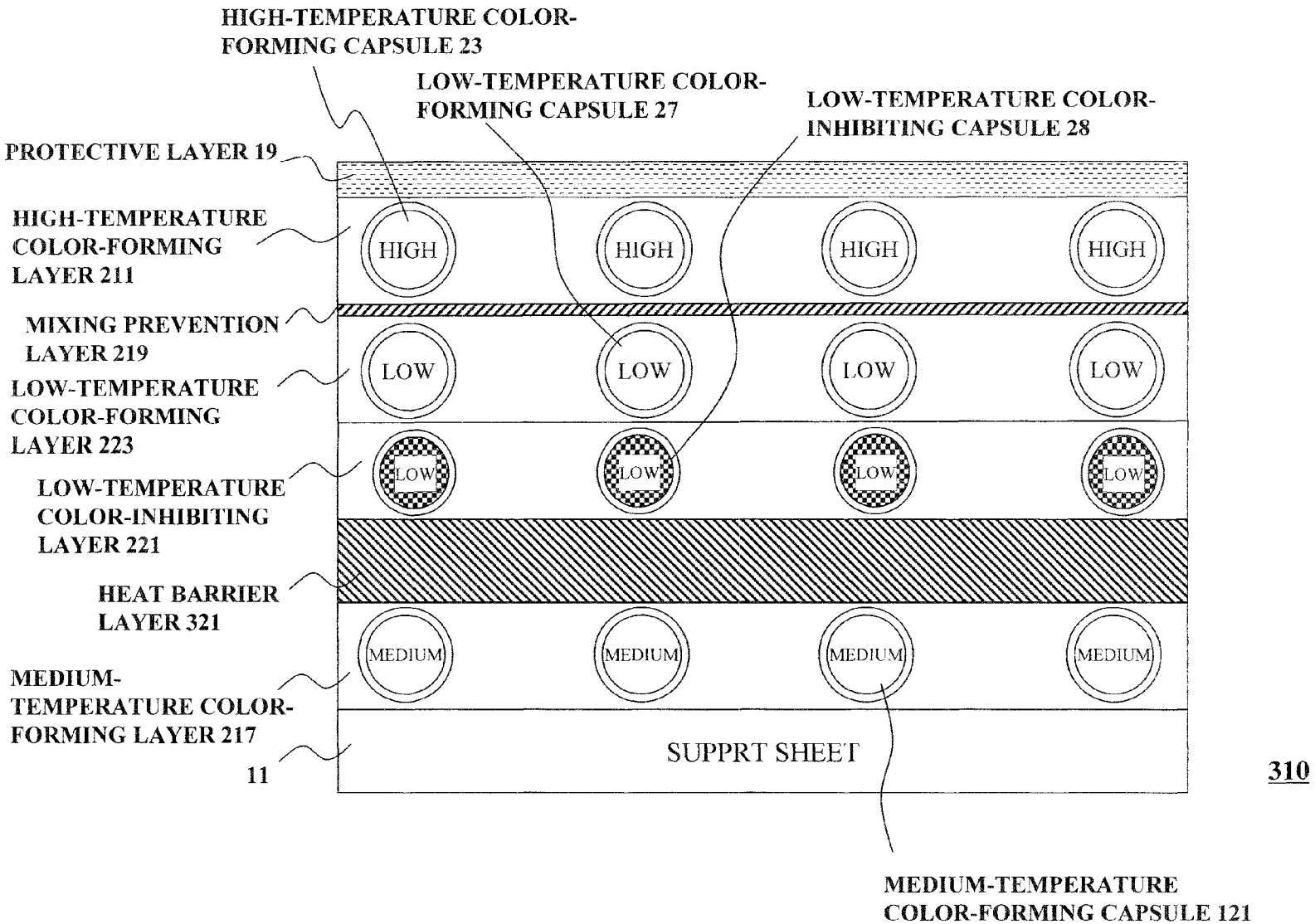
FIG. 15 is a schematic view of a recording sheet in accordance with the fourth embodiment of the present invention.
Figure 16:
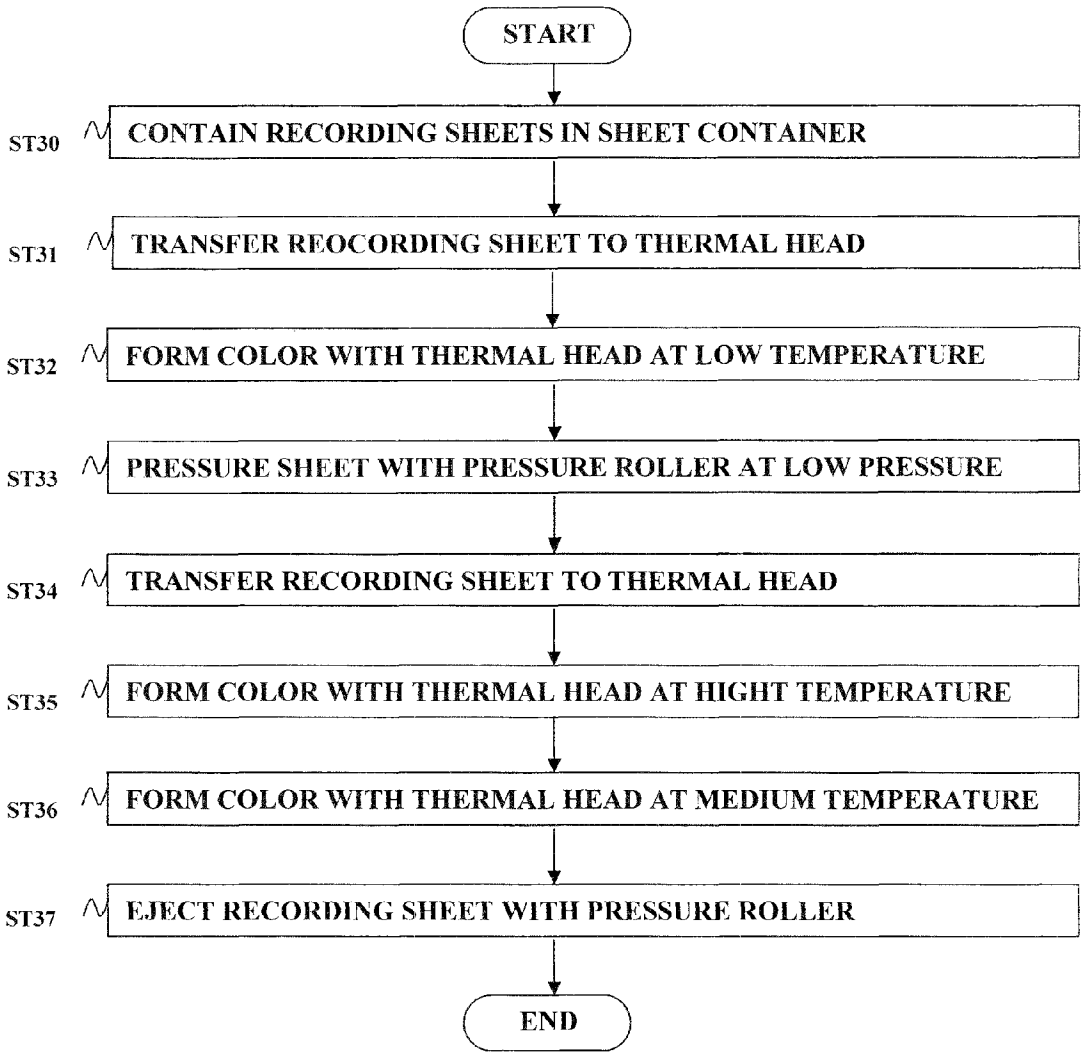
FIG. 16 is a flowchart illustrating image forming operations in accordance with the fourth embodiment of the present invention.
Figure 17:
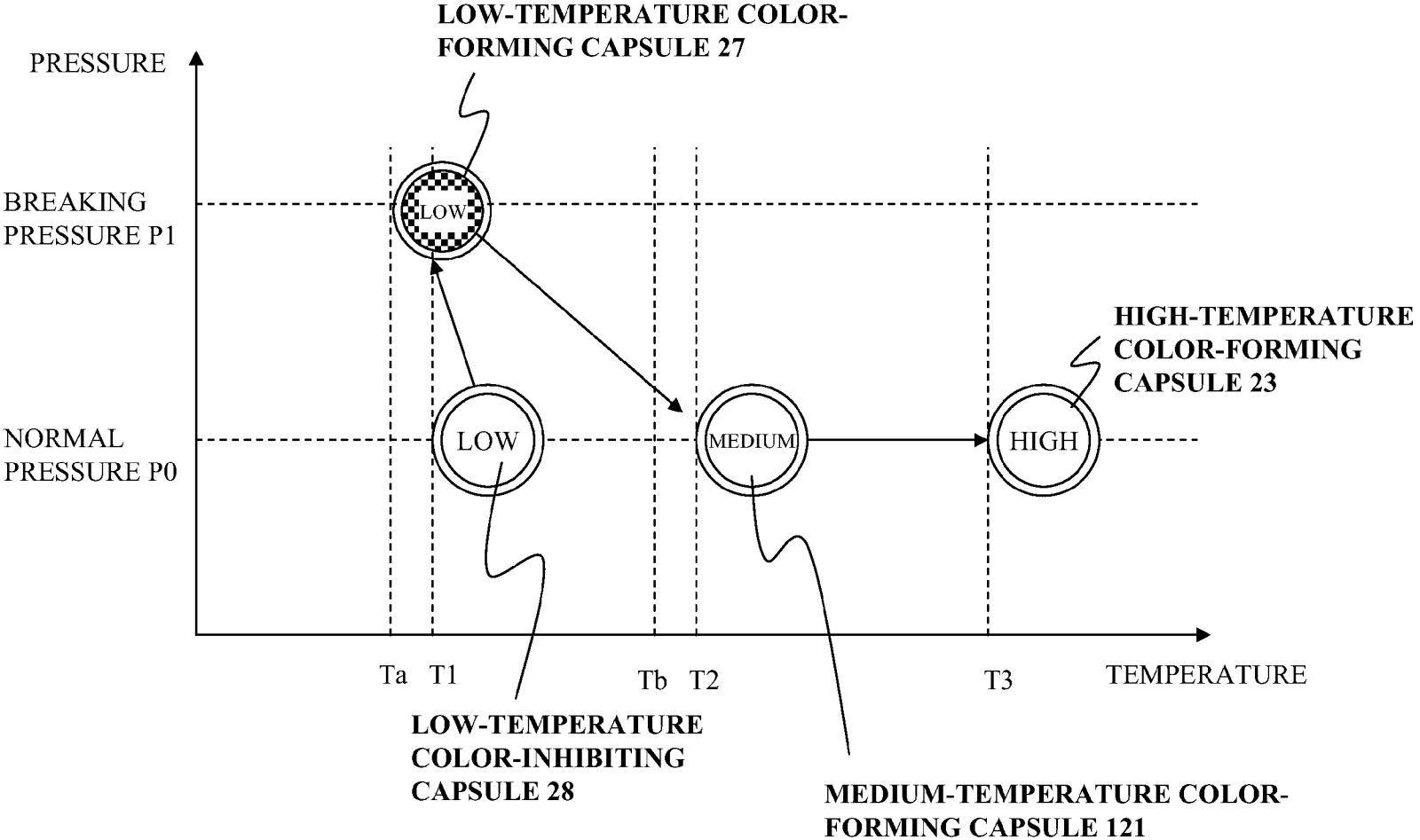
FIG. 17 is a schematic diagram illustrating characteristics of capsules such as a high-temperature color-forming capsule, a medium-temperature color-forming capsule, a low-temperature color-forming capsule, and a low-temperature color-inhibiting capsule, which are included in the recording sheet shown in FIG. 15.
Figure 18:
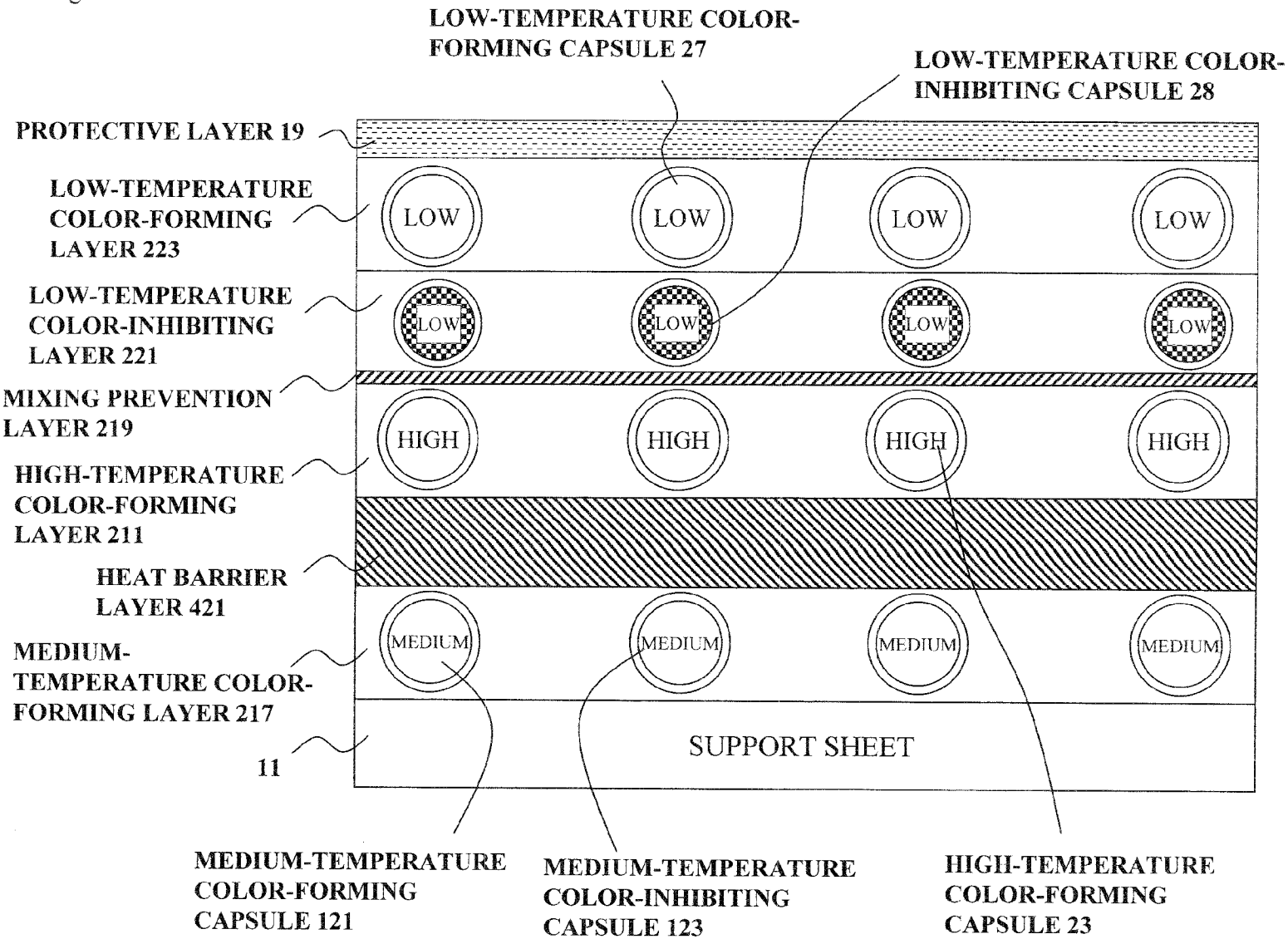
FIG. 18 is a schematic view of a modification to the recording sheet in accordance with the fourth embodiment of the present invention.
Figure 19:
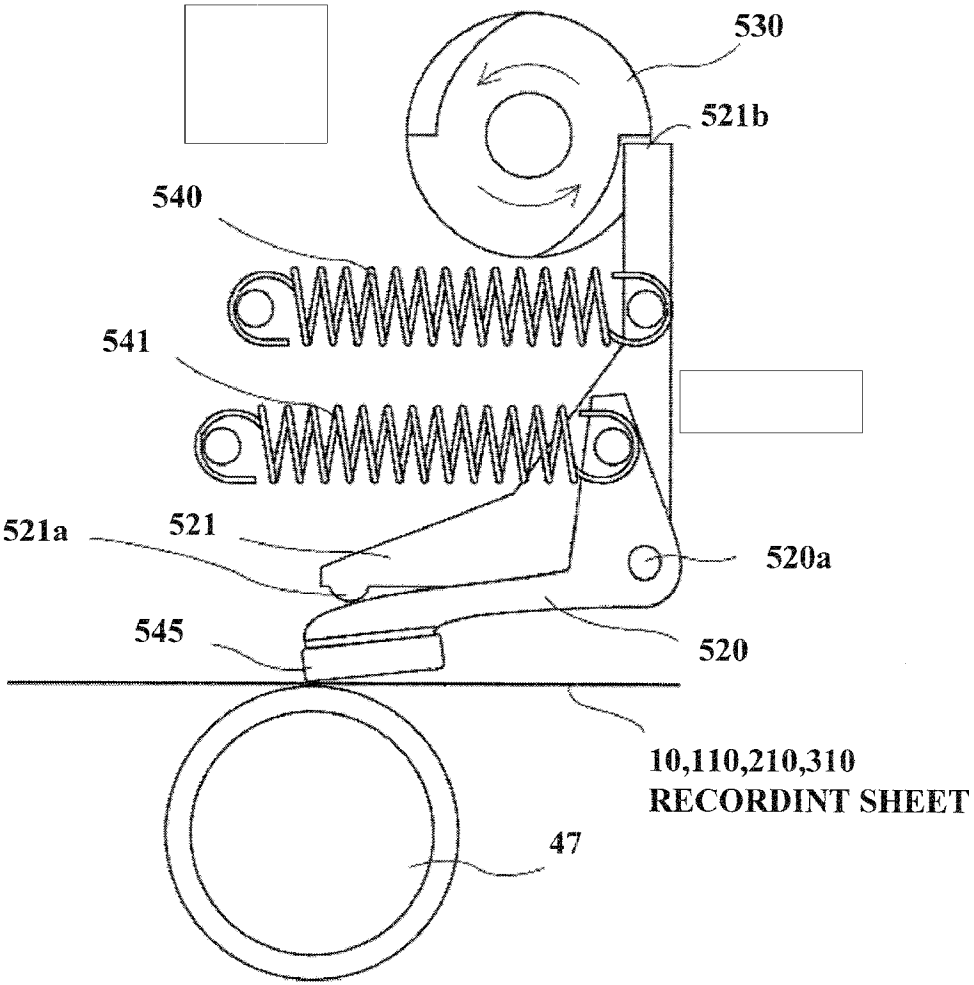
FIG. 19 is a schematic view of the first modification to the printer in accordance with the embodiments of the present invention.
Figure 20:
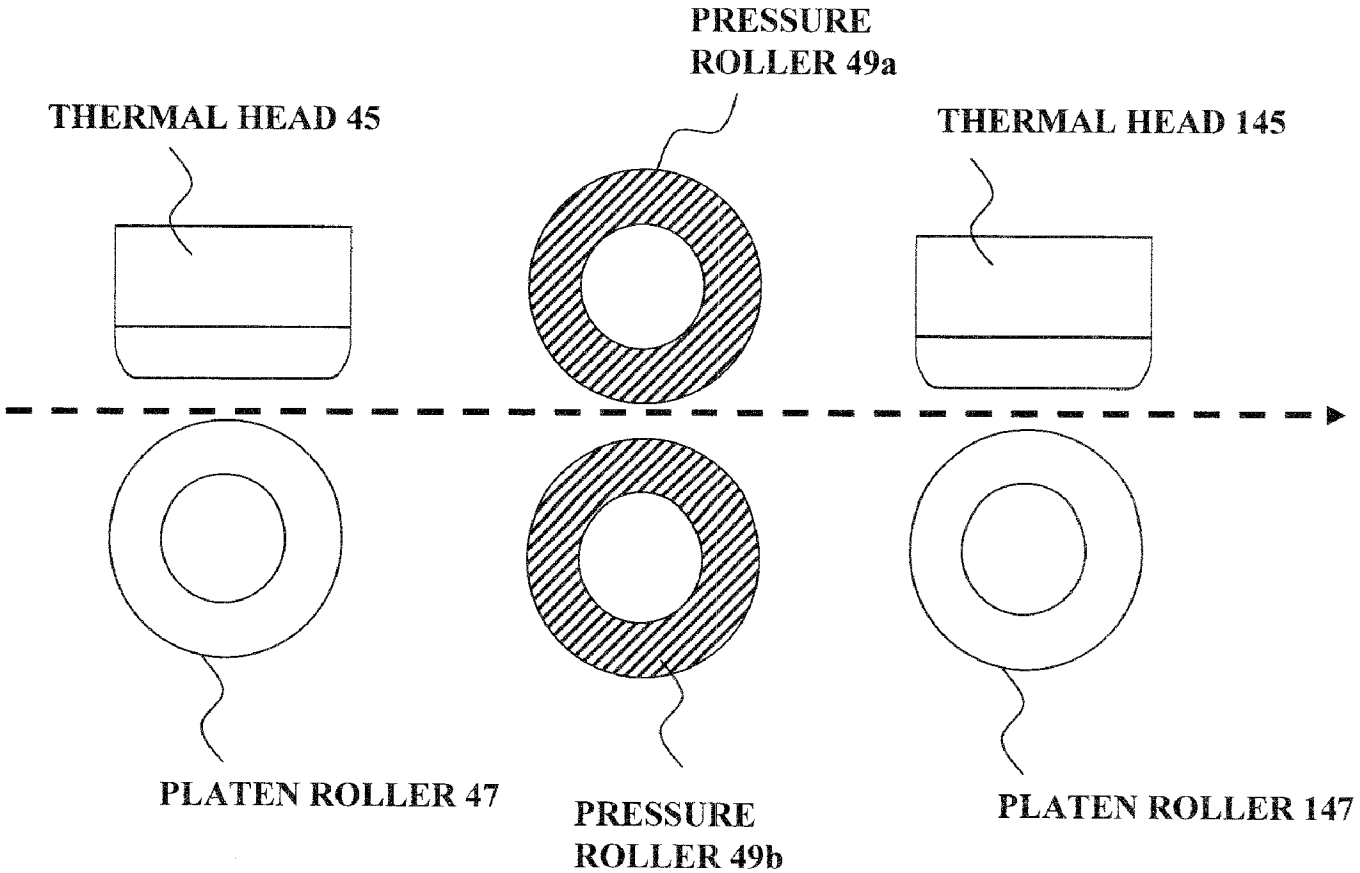
FIG. 20 is a schematic view of the second modification to the printer in accordance with the embodiments of the present invention.
Figure 21:
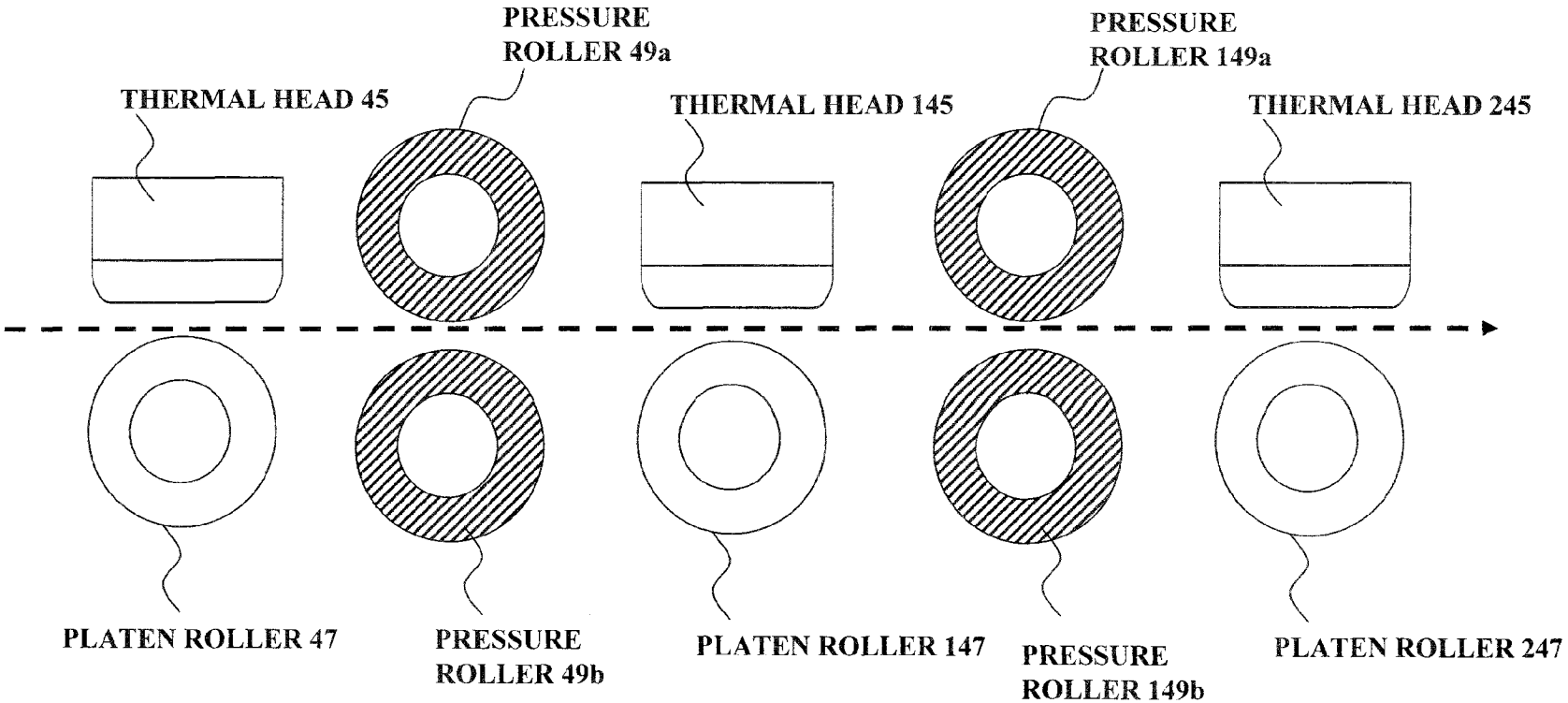
FIG. 21 is a schematic view of the third modification to the printer in accordance with the embodiments of the present invention.

10, 110, 210, 310 recording sheet
11 support sheet
13, 211 high-temperature color-forming layer
15, 213, 219 mixing prevention layer
17, 223 low-temperature color-forming layer
19 protective layer
23 high-temperature color-forming capsule
27 low-temperature color-forming capsule
28 low-temperature color-inhibiting capsule
41 sheet container
43 sheet transfer roller
45 thermal head
47 platen roller
49*a*, 49*b* pressure roller
60, 221 low-temperature color-inhibiting layer
113, 217 medium-temperature color-forming layer
121 medium-temperature color-forming capsule
123 medium-temperature color-inhibiting capsule

The invention claimed is:

1. A thermal recording medium comprising:

a first color-forming element that forms a color at a first color-forming temperature;

a second color-forming element that forms a color at a second color-forming temperature, the second color-forming temperature being higher than the first color-forming temperature; and a color-inhibiting element that inhibits a color-forming capability of the first color-forming element on condition that the color-inhibiting element is pressured by a predetermined pressure.

2. The thermal recording medium according to claim 1, comprising:

a first color-forming layer that includes the first color-forming elements;

a second color-forming layer that includes the second color-forming elements; and a color-inhibiting layer that includes the color-inhibiting elements, the color-inhibiting layer being in contact with the first color-forming layer.

3. The thermal recording medium as in claim 2, wherein each of the color-forming elements are placed in order from a heating side of the thermal recording medium toward the color-forming element having a lower color-forming temperature.

4. The thermal recording medium as in claim 2, wherein each of the color-forming elements are placed in order from a heating side of the thermal recording medium toward the color-forming element having a higher color-forming temperature.

5. The thermal recording medium according to claim 1, comprising:

a first color-forming layer that includes a mixture of the first color-forming elements and the color-inhibiting elements; and a second color-forming layer that includes the second color-forming elements.

6. The thermal recording medium as in claim 5, wherein each of the color-forming elements are placed in order from a heating side of the thermal recording medium toward the color-forming element having a lower color-forming temperature.

7. The thermal recording medium according to claim 1, comprising:

N (an integer not less than 3) types of color-forming elements including the first color-forming element and the second color-forming element; and (N-1) types of color-inhibiting elements that inhibit color-forming capabilities of (N-1) types of color-forming elements, the (N-1) types of color-forming elements being sequenced in order from a type of a smaller color-forming temperature to the (N-1) type of a larger color-forming temperature, wherein each of the (N-1) types color-inhibiting elements inhibits a capability of an associated color-forming element on condition that each color-inhibiting element is pressured and heated at a color-inhibiting temperature that is higher than that of another color-inhibiting element which inhibits a capability of a color-forming element having a color-forming temperature less than that of the associated color-forming element, and is lower than that of another color-inhibiting element which inhibits a capability of a color-forming element having a color-forming temperature more than that of the associated color-forming element.

8. The thermal recording medium as in claim 7, wherein each of the color-forming elements are placed in order from a heating side of the thermal recording medium toward the color-forming element having a lower color-forming temperature.

9. The thermal recording medium as in claim 1, wherein each of the color-forming elements are placed in order from a heating side of the thermal recording medium toward the color-forming element having a lower color-forming temperature.

10. The thermal recording medium as in claim 1, wherein each of the color-forming elements are placed in order from a heating side of the thermal recording medium toward the color-forming element having a higher color-forming temperature.

11. The thermal recording medium according to claim 1, further comprises a layer including high-temperature color-forming elements, a layer including low-temperature color-forming elements, a layer including color-inhibiting elements to inhibit the low-temperature color-forming elements, a heat barrier layer, and a layer including medium-temperature color-forming elements placed in order from a heating side of the thermal recording medium.

12. The thermal recording medium according to claim 1, further comprises a layer including low-temperature color-forming elements, a layer including color-inhibiting elements that inhibit the low-temperature color-forming elements, a layer including high-temperature color-forming elements, a heat barrier layer, and a layer including medium-temperature color-forming elements placed in order from a heating side of the thermal recording medium.

13. The thermal recording medium as in claim 1, wherein the color-forming element forms a color by releasing a substance inside the color-forming element and reacting the substance inside the color-forming element with a substance outside the color-forming element, or by letting the substance outside the color-forming element into the color-forming element and react the substance outside the color-forming element with the substance inside the color-forming element.

14. The thermal recording medium as in claim 1, wherein the color-inhibiting element has capabilities comprising at least one of:

a capability to inhibit color-forming reaction by changing a chemical constitution of one or more of color-forming-element substances such as electron donative dye precursor, electron acceptive color developer, basic substance, and acid substance;

a capability not to produce color dyes despite occurrence of chemical reaction by changing a chemical constitution of one or more of color-forming-element substances such as electron donative dye precursor, electron acceptive color developer, basic substance, and acid substance; and a capability to inhibit color-forming reaction by decreasing permeability of a microcapsule wall of the color-forming element.

15. An image forming method comprising:

a first process of heating a thermal recording medium to record an image at a low temperature in color forming, a second process of pressuring the thermal recording medium after the first process in order to inhibit the low-temperature color-forming, and a third process of heating the thermal recording medium at a high temperature in the color forming that is higher than the low temperature in the color forming in order to record an image on the thermal recording medium.

* * * * *